US012442276B2

(12) United States Patent
Tafur et al.

(10) Patent No.: US 12,442,276 B2
(45) Date of Patent: Oct. 14, 2025

(54) REDUNDANT TRIGGER SYSTEM

(71) Applicant: Schlumberger Technology Corporation, Sugar Land, TX (US)

(72) Inventors: Maria Fernanda Tafur, Houston, TX (US); Bo Chen, Stanford, CA (US); Yann Dufour, Houston, TX (US); Brian Walther, Missouri City, TX (US); Brad Swenson, Friendswood, TX (US); Steven E. Buchanan, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 148 days.

(21) Appl. No.: 18/552,475

(22) PCT Filed: Mar. 23, 2022

(86) PCT No.: PCT/US2022/021548
§ 371 (c)(1),
(2) Date: Sep. 26, 2023

(87) PCT Pub. No.: WO2022/204284
PCT Pub. Date: Sep. 29, 2022

(65) Prior Publication Data

US 2024/0368968 A1 Nov. 7, 2024

Related U.S. Application Data

(60) Provisional application No. 63/166,506, filed on Mar. 26, 2021.

(51) Int. Cl.
*E21B 34/14* (2006.01)

(52) U.S. Cl.
CPC ..... *E21B 34/14* (2013.01); *E21B 2200/04* (2020.05)

(58) Field of Classification Search
CPC ..... E21B 34/06; E21B 34/10
See application file for complete search history.

(56) References Cited

U.S. PATENT DOCUMENTS 3,819,282 A 6/1974 Schultz
4,031,826 A 6/1977 Gemmell et al.
(Continued)

FOREIGN PATENT DOCUMENTS

CA 2887636 C 12/2020
CN 107060720 A 8/2017
(Continued)

OTHER PUBLICATIONS

International Search Report and Written Opinion issued in the PCT Application PCT/US2020/029097 dated Jul. 27, 2021 (14 pages).
(Continued)

*Primary Examiner* — Tara Schimpf
*Assistant Examiner* — Ursula Lee Norris
(74) *Attorney, Agent, or Firm* — Jeffrey D. Frantz

(57) ABSTRACT

A redundant trigger section that actuates a device between operational positions in response to a controlled signal includes a housing including an internal through passage and a plurality of chambers formed in a wall of the housing, a pilot piston disposed within the internal through passage, an actuating piston connected to the pilot piston, and a plurality of triggers connected to the actuating piston. Upon receipt of the controlled signal by a first tubing pressure chamber of the plurality of chambers, at least one trigger of the plurality of triggers activates the actuating piston, which pushes the pilot piston within the internal through passage from an initial position to a final position.

20 Claims, 14 Drawing Sheets

(56) References Cited

U.S. PATENT DOCUMENTS

| | | | |
|---|---|---|---|
| 4,041,865 | A | 8/1977 | Evans et al. |
| 5,191,937 | A | 3/1993 | Cook, Sr. |
| 5,273,116 | A | 12/1993 | Ross |
| 5,392,856 | A | 2/1995 | Broussard, Jr. et al. |
| 5,435,390 | A | 7/1995 | Baugh et al. |
| 5,558,153 | A | 9/1996 | Holcombe et al. |
| 5,911,277 | A | 6/1999 | Hromas et al. |
| 6,021,095 | A | 2/2000 | Tubel et al. |
| 6,172,614 | B1 | 1/2001 | Robison et al. |
| 6,450,258 | B2 | 9/2002 | Green et al. |
| 6,450,263 | B1 | 9/2002 | Schwendemann |
| 6,925,807 | B2 | 8/2005 | Jones et al. |
| 6,945,331 | B2 | 9/2005 | Patel |
| 7,025,130 | B2 | 4/2006 | Bailey et al. |
| 7,108,073 | B2 | 9/2006 | Patel |
| 7,237,616 | B2 | 7/2007 | Patel |
| 7,336,474 | B2 | 2/2008 | Lerche et al. |
| 7,337,850 | B2 | 3/2008 | Contant |
| 7,347,272 | B2 | 3/2008 | Patel et al. |
| 7,367,405 | B2 | 5/2008 | Murray |
| 7,461,580 | B2 | 12/2008 | Bell et al. |
| 7,597,139 | B2 | 10/2009 | Moyes |
| 7,597,151 | B2 | 10/2009 | Curtis et al. |
| 7,604,062 | B2 | 10/2009 | Murray |
| 7,610,958 | B2 | 11/2009 | Moyes |
| 7,642,926 | B2 | 1/2010 | Liberale et al. |
| 7,673,680 | B2 | 3/2010 | Buyers et al. |
| 7,681,651 | B2 | 3/2010 | Loughlin |
| 7,681,652 | B2 | 3/2010 | Gaudette et al. |
| 7,748,462 | B2 | 7/2010 | Reid |
| 7,891,434 | B2 | 2/2011 | Gaudette et al. |
| 7,963,322 | B2 | 6/2011 | Richard et al. |
| 8,164,980 | B2 | 4/2012 | Sullivan et al. |
| 8,191,629 | B2 | 6/2012 | Gordon et al. |
| 8,469,106 | B2 | 6/2013 | Caminari et al. |
| 8,499,826 | B2 | 8/2013 | Hillis et al. |
| 8,517,113 | B2 | 8/2013 | Sheffield |
| 8,536,528 | B2 | 9/2013 | DiFoggio |
| 8,602,105 | B2 | 12/2013 | Sinclair |
| 8,616,276 | B2 | 12/2013 | Tips et al. |
| 8,684,093 | B2 | 4/2014 | Segura et al. |
| 8,689,887 | B2 | 4/2014 | Ross |
| 8,714,005 | B2 | 5/2014 | Vetter |
| 8,733,448 | B2 | 5/2014 | Skinner et al. |
| 8,776,890 | B2 | 7/2014 | Basmajian et al. |
| 8,851,160 | B2 | 10/2014 | Stolboushkin |
| 8,851,161 | B2 | 10/2014 | Scott et al. |
| 8,893,798 | B2 | 11/2014 | Hayter et al. |
| 8,943,884 | B2 | 2/2015 | Kumar |
| 8,991,496 | B2 | 3/2015 | Bishop |
| 9,022,108 | B2 | 5/2015 | Chatelet et al. |
| 9,103,197 | B2 | 8/2015 | Purkis |
| 9,121,250 | B2 | 9/2015 | Godfrey et al. |
| 9,145,980 | B2 | 9/2015 | Lauderdale |
| 9,163,488 | B2 | 10/2015 | Tips et al. |
| 9,273,549 | B2 | 3/2016 | Walton et al. |
| 9,309,745 | B2 | 4/2016 | Patel |
| 9,316,091 | B2 | 4/2016 | Symms |
| 9,353,600 | B2 | 5/2016 | Cong et al. |
| 9,359,865 | B2 | 6/2016 | Mailand |
| 9,404,340 | B2 | 8/2016 | Wood et al. |
| 9,428,999 | B2 | 8/2016 | Tips et al. |
| 9,598,933 | B2 | 3/2017 | Inglis |
| 9,631,445 | B2 | 4/2017 | Hradecky |
| 9,664,004 | B2 | 5/2017 | Martinez et al. |
| 9,664,007 | B2 | 5/2017 | Lopez et al. |
| 9,670,941 | B2 | 6/2017 | Dalton et al. |
| 9,745,823 | B2 | 8/2017 | Wood et al. |
| 9,777,557 | B2 | 10/2017 | Richard et al. |
| 9,845,661 | B2 | 12/2017 | Williamson et al. |
| 9,856,714 | B2 | 1/2018 | Giroux |
| 9,869,153 | B2 | 1/2018 | Moreno et al. |
| 9,903,192 | B2 | 2/2018 | Entchev et al. |
| 9,903,971 | B2 | 2/2018 | Swett |
| 9,926,769 | B2 | 3/2018 | Wood et al. |
| 9,958,838 | B2 | 5/2018 | Zacharko et al. |
| 10,066,467 | B2 | 9/2018 | Getzlaf et al. |
| 10,125,572 | B2 | 11/2018 | Wood et al. |
| 10,145,200 | B2 | 12/2018 | McKenzie |
| 10,174,586 | B2 | 1/2019 | Symms |
| 10,221,680 | B2 | 3/2019 | August et al. |
| 10,233,725 | B2 | 3/2019 | Provost |
| 10,253,594 | B2 | 4/2019 | Wakefield et al. |
| 10,287,851 | B2 | 5/2019 | El Mallawany |
| 10,301,908 | B2 | 5/2019 | Wakefield et al. |
| 10,309,174 | B2 | 6/2019 | Burgos et al. |
| 10,352,117 | B2 | 7/2019 | OConnor |
| 10,365,079 | B2 | 7/2019 | Harrington et al. |
| 10,408,025 | B2 | 9/2019 | Harrington et al. |
| 10,408,048 | B2 | 9/2019 | Roberson et al. |
| 10,480,283 | B2 | 11/2019 | Joseph et al. |
| 10,502,024 | B2 | 12/2019 | Wang et al. |
| 10,533,387 | B2 | 1/2020 | Dirksen et al. |
| 10,563,481 | B2 | 2/2020 | Richards |
| 10,584,560 | B2 | 3/2020 | Alley |
| 10,584,563 | B2 | 3/2020 | Richards et al. |
| 10,619,474 | B2 | 4/2020 | Ufondu et al. |
| 10,689,948 | B2 | 6/2020 | Hardesty et al. |
| 10,697,256 | B2 | 6/2020 | Wiedecke et al. |
| 10,781,677 | B2 | 9/2020 | MIcak |
| 10,794,157 | B2 | 10/2020 | Kohn et al. |
| 2004/0020643 | A1 | 2/2004 | Thomeer et al. |
| 2007/0144731 | A1 | 6/2007 | Murray et al. |
| 2008/0066921 | A1* | 3/2008 | Bane ..... E21B 34/10 166/332.8 |
| 2008/0066931 | A1 | 3/2008 | Xu |
| 2011/0056679 | A1 | 3/2011 | Rytlewski |
| 2011/0146984 | A1 | 6/2011 | Krush |
| 2011/0168403 | A1* | 7/2011 | Patel ..... E21B 47/12 166/373 |
| 2011/0265987 | A1 | 11/2011 | Wright et al. |
| 2012/0267119 | A1* | 10/2012 | Patel ..... E21B 34/10 166/373 |
| 2012/0285702 | A1 | 11/2012 | Rytlewski |
| 2013/0306374 | A1 | 11/2013 | Wood |
| 2014/0246236 | A1 | 9/2014 | Radford |
| 2017/0275984 | A1 | 9/2017 | Wang et al. |
| 2019/0055816 | A1 | 2/2019 | Johnson et al. |
| 2019/0376368 | A1 | 12/2019 | Miller et al. |
| 2020/0072045 | A1 | 3/2020 | Bramlage et al. |
| 2020/0115992 | A1 | 4/2020 | Wang et al. |
| 2021/0363859 | A1* | 11/2021 | Inglis ..... E21B 34/10 |
| 2022/0186585 | A1* | 6/2022 | Elston ..... E21B 34/10 |
| 2024/0183237 | A1* | 6/2024 | Dufour ..... E21B 23/0412 |

FOREIGN PATENT DOCUMENTS

| | | | |
|---|---|---|---|
| EP | 3012400 | B1 | 4/2020 |
| GB | 2280013 | A | 1/1995 |
| WO | 2006000799 | A2 | 1/2006 |
| WO | 2007103680 | A1 | 9/2007 |
| WO | 2008060893 | A2 | 5/2008 |
| WO | 2009105128 | A1 | 8/2009 |
| WO | 2009154817 | A2 | 12/2009 |
| WO | 2011119448 | A2 | 9/2011 |
| WO | 2014210367 | A2 | 12/2014 |
| WO | 2017213885 | A1 | 12/2017 |
| WO | 2018118921 | A1 | 6/2018 |
| WO | 2018132666 | A1 | 7/2018 |
| WO | 2019132969 | A1 | 7/2019 |
| WO | 2019183316 | A1 | 9/2019 |
| WO | 2020219435 | A1 | 10/2020 |
| WO | 2021167917 | A1 | 8/2021 |
| WO | 2021168032 | A1 | 8/2021 |
| WO | 2022010993 | A1 | 1/2022 |
| WO | 2022216535 | A1 | 10/2022 |

OTHER PUBLICATIONS

International Preliminary Report on Patentability issued in the PCT Application PCT/US2020/029097 dated Oct. 4, 2021 (11 pages).

International Search Report and Written Opinion issued in the PCT Application PCT/US2022/021548 dated Jun. 23, 2022 (10 pages).

(56) References Cited

OTHER PUBLICATIONS

International Search Report and Written Opinion issued in the PCT Application PCT/US2022/022992 dated Jul. 8, 2022 (10 pages).

* cited by examiner

REDUNDANT TRIGGER SYSTEM

CROSS-REFERENCE TO RELATED APPLICATIONS

This application is a National Stage of International Application No. PCT/US2022/021548, filed Mar. 23, 2022, which claims the benefit of U.S. Provisional Application No. 63/166,506 entitled "Redundant Trigger System," filed Mar. 26, 2021, the disclosure of which are incorporated herein by reference in their entirety.

BACKGROUND

An isolation valve is a device that provides isolation to a reservoir. Specifically, a formation isolation valve is downhole completion equipment that is used to provide two-way isolation from the formation. This double isolation allows the performance of completion operations without placing a column of heavy fluid in the wellbore to prevent the production of reservoir fluids. Although the main purpose of a formation isolation valve is formation isolation, the versatility of the formation isolation valve may be seen in a broad range of applications including prevention of fluid loss, packer setting, and lateral isolation.

An isolation valve, such as a formation isolation valve, may include at least a trigger section and an actuator to remotely change the state of the isolation valve. Because failure of the remote opening mechanism in the trigger section may be catastrophic, there is a need to increase the reliability of this mechanism in isolation valves.

SUMMARY

According to one or more embodiments of the present disclosure, a system for use in a well, includes: a well string having an isolation valve disposed along the well string to selectively block or allow fluid flow along an interior of the well string, the isolation valve including: a ball section having a ball valve element rotatable between a closed position and an open position, a mechanical section coupled with the ball section to rotate the ball valve element, and a redundant trigger section that actuates the mechanical section, and thus the ball section, in response to a controlled signal, the redundant trigger section having: a valve block having a housing including a first end and a second end, the valve block further including: a pilot piston disposed within an internal through passage of the housing between the first and second ends of the housing, the pilot piston having an initial position, a plurality of chambers formed in a wall of the housing, the plurality of chambers including: a first tubing pressure chamber; an atmospheric pressure chamber; a lower chamber; and an upper chamber, wherein the upper chamber is disposed at the second end of the housing, the upper chamber being coaxial with the internal through passage of the housing; and an actuating piston connected to the pilot piston at the first end of the housing; a plurality of triggers connected to the actuating piston; wherein, upon receipt of the controlled signal by the first tubing pressure chamber, at least one trigger of the plurality of triggers activates the actuating piston, which pushes the pilot piston within the internal position to a final position; and a lower coupling disposed at the upper chamber that couples the valve block to the mechanical section.

According to one or more embodiments of the present disclosure, a system includes a redundant trigger section that actuates a device between operational positions in response to a controlled signal, the redundant trigger section including: a housing including: an internal through passage; and a plurality of chambers formed in a wall of the housing; a pilot piston disposed within the internal through passage of the housing, the pilot piston having an initial position; an actuating piston connected to the pilot piston at a first end of the housing, wherein the plurality of chambers includes: a first tubing pressure chamber; an atmospheric pressure chamber; a lower chamber; and an upper chamber, wherein the upper chamber is disposed at a second end of the housing opposite the first end of the housing, the upper chamber being coaxial with the internal through passage of the housing; and a plurality of triggers connected to the actuating piston, wherein, upon receipt of the controlled signal by the first tubing pressure chamber, at least one trigger of the plurality of triggers activates the actuating piston, which pushes the pilot piston within the internal through passage of the housing from the initial position to a final position.

According to one or more embodiments of the present disclosure, a system includes a redundant section that actuates a device between operational positions in response to a controlled signal, the redundant trigger section including: a valve block including: a housing having an internal through passage; a pilot piston disposed within the internal through passage of the housing, the pilot piston having an initial position; a shuttle valve disposed at an uphole end of the housing of the valve block, the shuttle valve being hydraulically connected to the pilot piston; a plurality of chambers formed in a wall of the housing, the plurality of chambers including: a shuttle valve pressure chamber connected to the shuttle valve; an atmospheric pressure chamber; a lower chamber; and an upper chamber, wherein the upper chamber is disposed at a downhole end of the housing, the upper chamber being coaxial with the internal through passage of the housing; a plurality of triggers hydraulically connected to the shuttle valve, the plurality of triggers being exposed to tubing pressure, wherein the plurality of triggers acts as a plurality of valves controlling an input of hydraulic fluid into the valve block via the shuttle pressure valve pressure chamber and the shuttle valve to move the pilot piston, wherein, upon receipt of the controlled signal by at least one trigger of the plurality of triggers, the at least one trigger acting as a valve opens fluid communication to the shuttle valve through the shuttle valve pressure chamber, which pushes the pilot piston within the internal through passage of the housing from the initial position to a final position.

According to one or more embodiments of the present disclosure, a system includes: a redundant triggers section that actuates a device between operational positions in response to a controlled signal, the redundant trigger section including: a first trigger connected to a first valve block; a second trigger connected to a second valve block, wherein each of the first and second valve blocks includes: a housing having an internal through passage; a pilot piston disposed within the internal through passage of the housing, the pilot piston having an initial position; a plurality of chambers formed in a wall of the housing, the plurality of chambers including: a first tubing pressure chamber; an atmospheric pressure chamber; a second tubing pressure chamber; and an upper chamber, wherein the upper chamber is disposed at a downhole end of the housing, the upper chamber being coaxial with the internal through passage of the housing; a manifold hydraulically connected to the second tubing pressure chamber of the first and second valve blocks, the manifold comprising: a third tubing pressure chamber; a lower chamber; a fourth tubing pressure chamber; a first pilot check valve assembly; and a second pilot check valve assembly, wherein the manifold is hydraulically connected to the second tubing pressure chamber of the first valve block via the third tubing pressure chamber, wherein the manifold is hydraulically connected to the second tubing pressure chamber of the second valve block via the fourth tubing pressure chamber, wherein each of the first and second pilot check valve assemblies includes a plurality of ports; a pilot check piston; and a pilot check valve; wherein the plurality of ports includes: port A, which is proximate the pilot check valve; port B, which is proximate the pilot check piston; and port C, which is disposed between port A and port B, wherein port B remains sealed, wherein port C of the first and second pilot check valve assemblies is included in a central connection between the first and second pilot check valve assemblies, wherein port C of the first and second pilot check valve assemblies is connected to the central chamber of the manifold, and wherein port C of the first and second pilot check valve assemblies is hydraulically connected to the first and second valve blocks, wherein, upon receipt of the controlled signal by the first tubing pressure chamber of the first valve block, the first trigger actuates the pilot piston of the first valve block, which pauses the pilot piston of the first valve block within the internal through passage of the housing from the initial position to a final position, wherein, in the initial position, the second tubing pressure chamber of the first valve block is in fluid communication with the upper chamber of the first valve block, wherein, in the final position, the second tubing pressure chamber of the first valve block is isolated from the upper chamber of the first valve block, wherein the second tubing pressure chamber of the second valve block inputs tubing pressure into the fourth tubing pressure chamber of the manifold, which seals the pilot check valve of the first pilot check valve assembly, and presses the pilot check piston of the second pilot check valve assembly into the pilot check valve of the second pilot check valve assembly, thereby opening free flow from port C to port A of the second pilot check valve assembly, wherein fluid that flows into the central chamber of the manifold is directed through port C of the first and second pilot check valve assemblies, through port A of the second pilot check valve assembly, into the fourth tubing pressure chamber of the manifold, into the second tubing pressure chamber of the first valve block, and into the atmospheric pressure chamber of the first valve block, and wherein draining the fluid from the central chamber of the manifold into the atmospheric pressure chamber of the first valve block creates a pressure differential that actuates the device.

According to one or more embodiments of the present disclosure, a system includes: a redundant trigger section that actuates a device between operational positions in response to a controlled signal, the redundant trigger section including: a first trigger connected to a first valve block; a second trigger connected to a second valve block, wherein each of the first and second valve blocks includes: a housing having an internal through passage; a pilot piston disposed within the internal through passage of the housing, the pilot piston having an initial position; a plurality of chambers formed in a wall of the housing, the plurality of chambers including: a first tubing pressure chamber; an atmospheric pressure chamber; a second tubing pressure chamber; and an upper chamber, wherein the upper chamber is disposed at a downhole end of the housing, the upper chamber being coaxial with the internal through passage of the housing; a manifold hydraulically connected to the second tubing pressure chambers of the first and second valve blocks, the manifold including: a third tubing pressure chamber; a central chamber; a fourth tubing pressure chamber; a first pilot check valve assembly; and a second pilot check valve assembly, wherein the manifold is hydraulically connected to the second tubing pressure chamber of the first valve block via the third tubing pressure chamber, wherein the manifold is hydraulically connected to the second tubing pressure chamber of the second valve block via the fourth tubing pressure chamber, wherein each of the first and second pilot check valve assemblies includes: a plurality of ports; a pilot check piston; and a pilot check valve, wherein the plurality of ports includes: port A, which is proximate the pilot check valve; port B, which is proximate the pilot check piston; and port C, which is disposed between port A and port B, wherein port B remains sealed; wherein port C of the first and second pilot check valve assemblies is included in a central connection between the first and second pilot check valve assemblies, wherein port C of the first and second pilot check valve assemblies is connected to the central chamber of the manifold, and wherein port C of the first and second pilot check valve assemblies is hydraulically connected to the first and second valve blocks, wherein, upon receipt of the controlled signal by the first tubing pressure chamber of the second valve block, the second trigger actuates the pilot piston of the second valve block, which pushes the pilot piston of the second valve block within the internal through passage of the housing from the initial position to a final position, wherein in the initial position, the second tubing pressure chamber of the second valve block is in fluid communication with the upper chamber of the second valve block, wherein, in the final position, the second tubing pressure chamber of the second valve block is isolated from the upper chamber of the second valve block, wherein the second tubing pressure chamber of the first valve block inputs tubing pressure into the third tubing pressure chamber of the manifold, which seals the pilot check valve of the second pilot check valve assembly, and presses the pilot check piston of the first pilot check valve assembly into the pilot check valve of the first pilot check valve assembly, thereby opening free flow from port C to port A of the first pilot check valve assembly, wherein fluid that flows into the central chamber of the manifold is directed through port C to port A of the first pilot check valve assembly, into the fourth tubing pressure chamber of the manifold, into the second tubing pressure chamber of the second valve block, and into the atmospheric pressure chamber of the second valve block, and wherein draining the fluid from the central chamber of the manifold into the atmospheric pressure chamber of the second valve block creates a pressure differential that actuates the device.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
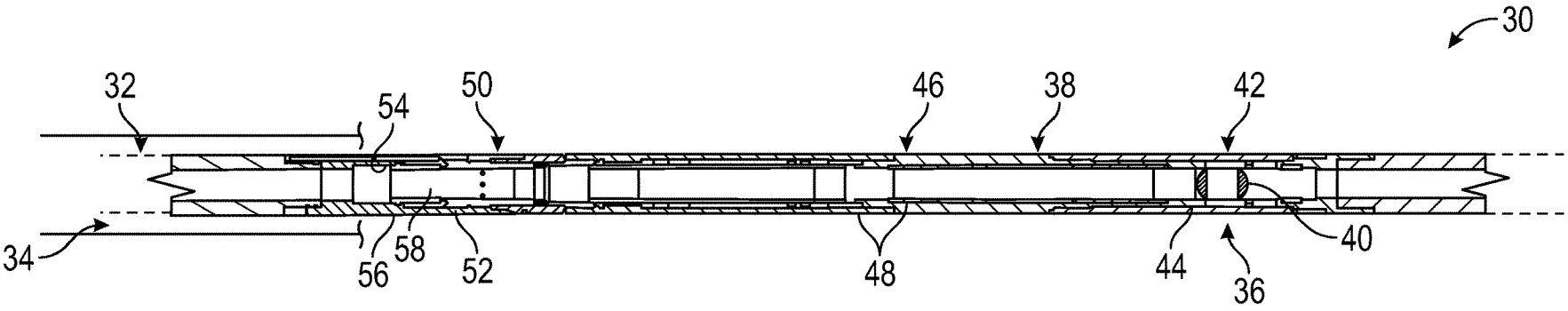
FIG. 1 shows a cross-sectional illustration of an example of a well string deployed in a wellbore and combined with an isolation valve, according to one or more embodiments of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

The present disclosure generally relates to systems and methods that facilitate actuation of an isolation valve or other downhole device. According to one or more embodiments of the present disclosure, an isolation valve includes an isolation valve member, e.g., a ball valve element, which may be actuated between positions. For example, the isolation valve member may be actuated between closed and open positions by a mechanical section having a shifting linkage.

In one or more embodiments of the present disclosure, actuation of the mechanical section, and thus actuation of the isolation valve member, is achieved by a redundant trigger section controlled according to a signal, which may be applied from the surface or from another suitable location. Indeed, one way to increase the reliability of remote opening of the isolation valve member is to introduce redundancy into the mechanism via the redundant trigger section according to one or more embodiments of the present disclosure. Advantageously, the redundant trigger section according to one or more embodiments of the present disclosure provides two independent and equally reliable remote activation triggers, which may be installed simultaneously in a valve block of the redundant trigger section of the isolation valve. In one or more embodiments of the present disclosure, the first trigger may be a hydraulic trigger, and the second trigger may be an electronic trigger, for example. Other combinations are conceivable, and are within the scope of the present disclosure. For example, both triggers may be hydraulic triggers, or both triggers may be electronic triggers. Alternatively, the triggers may be any type of trigger.

In one or more embodiments of the present disclosure, the redundant trigger section includes a valve block, a pilot piston, an actuating piston or a shuttle valve, a plurality of chambers, and a plurality of triggers installed in a single valve block, as previously described. Alternatively, instead of a plurality of triggers installed in a single valve block, one or more embodiments of the present disclosure may include two valve blocks with one trigger installed in each valve block, and a manifold that hydraulically connects the two valve blocks. In any case, in response to a controlled signal, the redundant trigger section according to one or more embodiments of the present disclosure is configured to shift the pilot piston from an initial position to a final position in order to actuate the mechanical section, and thus the ball valve element, of the isolation valve.

Referring now to FIG. 1, an example of a well system 30 is illustrated. The well system 30 may include a well string 32, e.g., a well completion string, deployed in a wellbore 34 or other type of borehole. The well system 30 also may include an actuatable device 36, which may be selectively actuated between operational positions in response to a controlled signal. For example, the controlled signal may be supplied from the surface and down through well string 32 to initiate actuation of device 36. Specifically, in one or more embodiments of the present disclosure, the controlled signal may be conveyed through a column of fluid inside the well string 32, for example. In one or more embodiments of the present disclosure, the nature of the controlled signal may be electric, electromagnetic, acoustic, optic, chemical, a series of pressure pulses, a pressure differential, and/or a temperature differential, for example.

Still referring to FIG. 1, the actuatable device 36 according to one or more embodiments of the present disclosure may be part of an isolation valve 38 disposed along the well string 32. For example, the actuatable device 36 may be in the form of a ball valve element 40 or other type of actuatable valve element. According to the illustrated embodiment, the isolation valve 38 may include a ball section 42, which includes the ball valve element 40 rotatably mounted in a corresponding ball section housing 44. In one or more embodiments of the present disclosure, the ball valve element 40 may rotate open or closed with special seals to secure effective isolation along an interior of the well string 32 and to prevent entry of unwanted debris.

Still referring to FIG. 1, the ball valve element 40 (or other actuatable device) may be shifted between operational positions via a mechanical section 46 coupled with the ball section 42. According to one or more embodiments of the present disclosure, the mechanical section 46 may include a mechanical linkage 48 connected to the ball valve element 40 or other actuatable device. According to one or more embodiments of the present disclosure, the mechanical linkage 48 may include a mechanical shifting profile and a position-lock collet, for example. The mechanical section 46 and mechanical linkage 48 are operatively coupled with the trigger section 50, which includes a remote opening mechanism that responds to a controlled signal to cause shifting of, for example, mechanical linkage 48 and ball valve element 40. In one or more embodiments of the present disclosure, the trigger section 50 may be a redundant trigger section as further described below. By way of example, the redundant trigger section 50 may be used to shift the ball valve element 40 from a closed position to an open position via the controlled signal applied from the surface or other suitable location, according to one or more embodiments of the present disclosure.

Figure 2A:
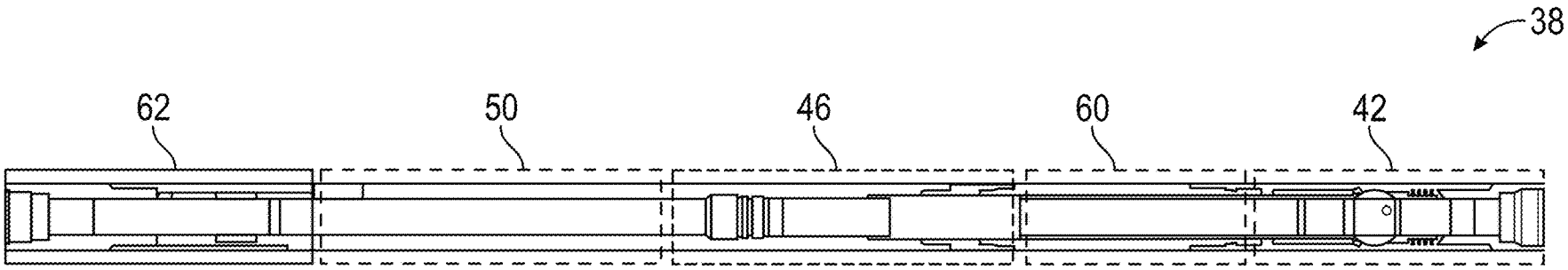
FIGS. 2A and 2B show an example of an isolation valve that uses a single hydromechanical trigger for remote activation.
Figure 2B:
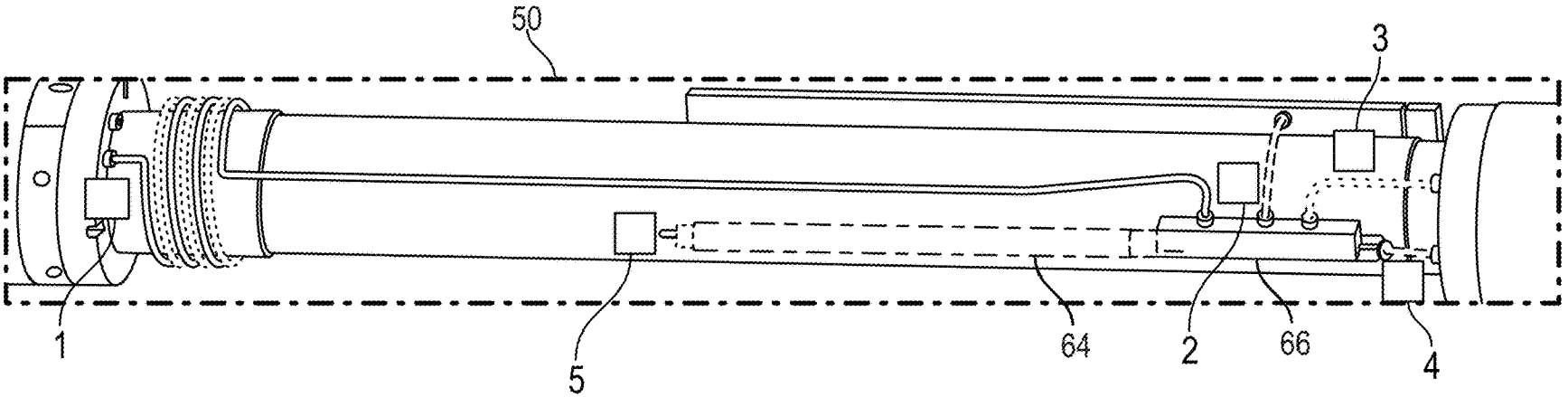

Referring now to FIGS. 2A and 2B, an example of an isolation valve 38 that uses a single trigger 64 (illustrated as a hydromechanical trigger, or an "H-trigger," in FIG. 2B) for remote activation is shown for additional context. As shown in FIG. 2A, the isolation valve 38 includes a trigger section 50, which is an H-trigger section in this example, a mechanical section 46, and a ball section 42, as previously described. As further shown in FIG. 2A, the isolation valve 38 may also include an extension section 60 and/or a compensator section 62. As further shown in FIG. 2B, the H-trigger section includes a valve block 66 having a plurality of ports, including an upper port connected to an oil compensator (1), an upper-middle port connected to an atmospheric receptacle (2), a lower-middle port connected to a lower actuation chamber (3), and a lower port connected to an upper actuation chamber (4). As further shown in FIG. 2B, the H-trigger section may also include an annulus pressure for mechanical compensator (5).

Still referring to FIGS. 2A and 2B, as an operational example, when pressure pulses or another controlled signal are applied through tubing, a ratchet mechanism of the H-trigger begins moving left. After several pressure pulses, a long rod (coupled to ratchet) fully displaces right, and a retaining collet collapses inward and pushes a pilot piston in a valve block of the H-trigger section fully to the right. The displacement of the pilot piston bleeds the pressure in the lower chamber in the mechanical section initially at tubing pressure, to an atmospheric chamber. This change in pressure in the lower chamber allows the tubing pressure in the upper chamber to push the sleeves attached to the ball in the downhole direction. This motion rotates open the ball. Such H-trigger section configurations are described in PCT/US2021/018278 and WO2020/219435, which are incorporated herein by reference in their entirety. However, other H-trigger section configurations are contemplated, and may be within the scope of the present disclosure.

Figure 3A:
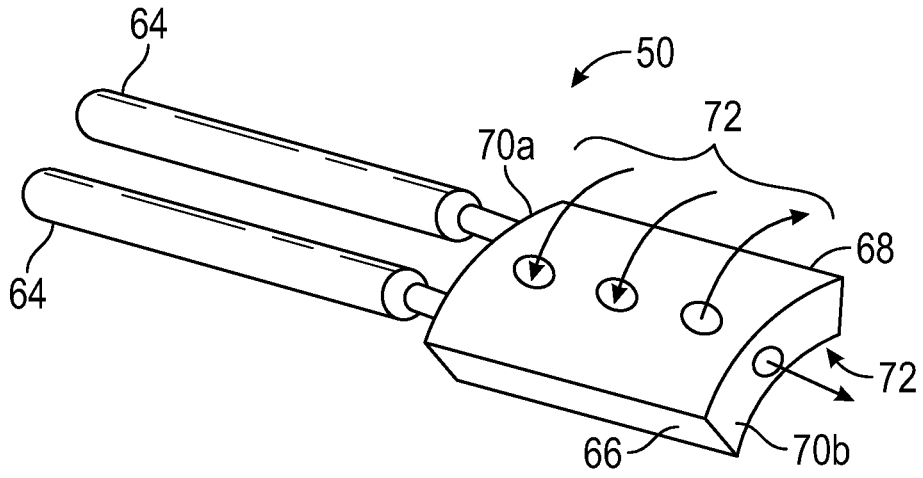
FIGS. 3A and 3B show a general architecture of a redundant trigger section, according to one or more embodiments of the present disclosure.
Figure 3B:
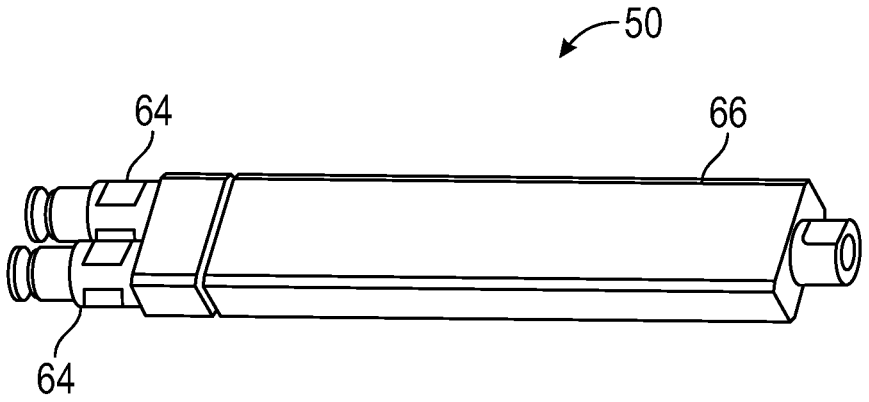

In view of the above, FIG. 2B shows a single trigger 64 (illustrated as an H-trigger) installed in a single valve block 66 of the triggering section 50. In a redundant trigger section 50 according to one or more embodiments of the present disclosure, multiple triggers 64, for example, two triggers 64, may be installed in a single valve block 66, as shown in FIGS. 3A and 3B, for example. Introducing redundancy into the trigger section 50 may increase the reliability of the remote opening mechanism of the trigger section 50. Indeed, if the trigger section 50 includes only a single trigger, and the remote opening mechanism of the trigger section 50 fails, such a failure may be classified as catastrophic for the isolation valve.

Still referring to FIGS. 3A and 3B, one of the triggers 64 of the redundant trigger section 50 may be an H-trigger, as previously described, and the other trigger 64 may be an electronic trigger or "eTrigger," for example. Such an eTrigger configuration is described in PCT/US2021/018451, which is incorporated herein by reference in its entirety. However, other eTrigger configurations are contemplated, and may be within the scope of the present disclosure. In other embodiments of the present disclosure, both triggers 64 may be H-triggers, both triggers 64 may be eTriggers, or both triggers 64 may be any type of trigger, for example. Further, while FIGS. 3A and 3B show two triggers 64 connected simultaneously to a single valve block 66, more than two triggers 64 may be connected simultaneously to the single valve block 66 in one or more embodiments of the present disclosure. Indeed, the key feature of the redundant trigger section 50 according to one or more embodiments of the disclosure is the redundancy afforded by having a plurality of triggers 64 connected to the single valve block 66, or if a single trigger 64 is connected to a single valve block 66, including multiple valve blocks 66 in the redundant trigger section 50, as further described below.

Still referring to FIGS. 3A and 3B, each trigger of the plurality of triggers 64 is capable of receiving a controlled signal from the surface or another suitable location to facilitate actuation of internal components of the valve block 66, which may ultimately rotate the ball valve element 40 of the ball section 42 from a closed position to an open position. Stated another way, the redundant trigger section 50 according to one or more embodiments of the present disclosure actuates the mechanical section 46, and thus the ball section 42, of the isolation valve 38, in response to the controlled signal. According to one or more embodiments of the present disclosure, the controlled signal may be the same for each trigger of the plurality of triggers 64, or the controlled signal may be unique for each trigger of the plurality of triggers 64.

Referring specifically to FIG. 3A, the valve block 66 of the redundant trigger section 50 according to one or more embodiments of the present disclosure includes a housing 68 having a first end 70*a* and a second end 70*b*. As further shown in FIG. 3A, the valve block 66 of the redundant trigger section 50 according to one or more embodiments of the present disclosure includes a plurality of chambers 72 formed in a wall of the housing 68.

Figures 4A, 4B, 4C, 4D:
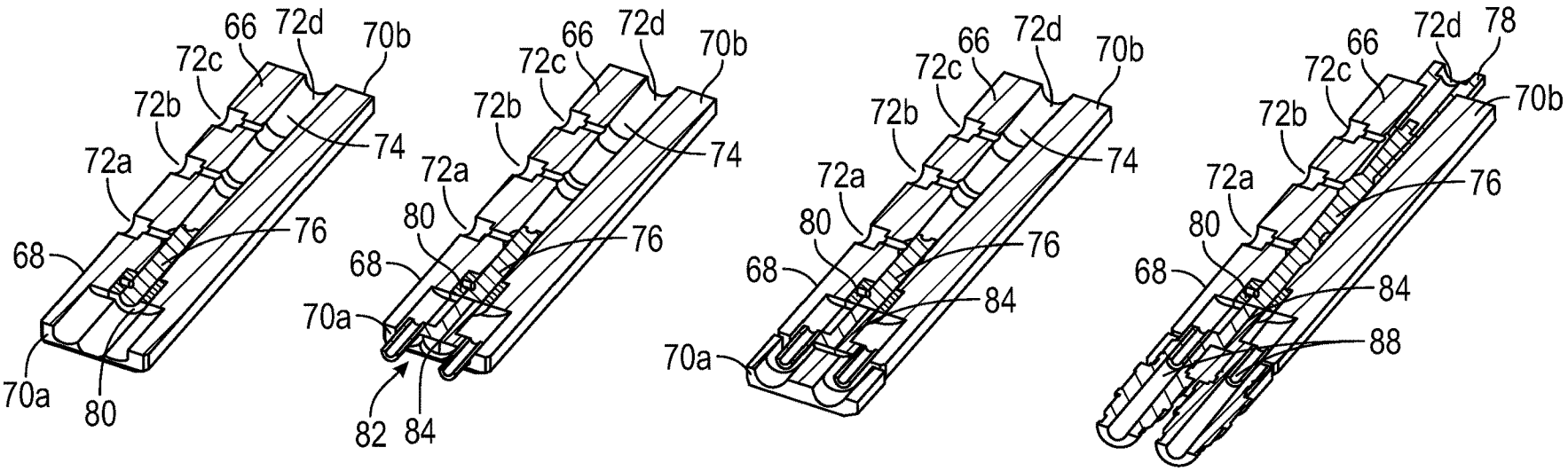
FIGS. 4A-4E show cross-sectional views of an assembly of a valve block of a redundant trigger section, according to one or more embodiments of the present disclosure.

Referring now to FIGS. 4A-4E, cross-sectional views of an assembly of a valve block 68 of a redundant trigger section 50 according to one or more embodiments of the present disclosure are shown. Specifically, FIGS. 4A-4D show the plurality of chambers 72 formed in the wall of the housing 68 of the valve block 66, as previously described in view of FIG. 3A. As shown in FIGS. 4A-4D, the plurality of chambers 72 may include a first tubing pressure chamber 72*a*, an atmospheric pressure chamber 72*b*, a lower chamber 72*c*, and an upper chamber 72*d*. According to one or more embodiments of the present disclosure, the upper chamber 72*d* may be disposed at the second end 70*b* of the housing 68 of the valve block 66, and the upper chamber 72*d* may be coaxial with the internal through passage 74 of the housing 68. Further, as shown in FIG. 4D, a lower coupling 78 may be disposed at the upper chamber 72*d*, the lower coupling 78 being configured to couple the valve block 66 of the redundant trigger section 50 to the mechanical section 46 of the isolation valve 38, as previously described.

Figure 9:
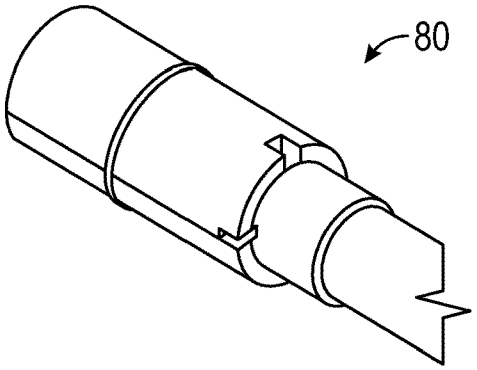
FIG. 9 shows a perspective view of a locking mechanism of a redundant trigger section, according to one or more embodiments of the present disclosure.

Still referring to FIGS. 4A-4D, the valve block 66 may also include an internal through passage 74, and a pilot piston 76 disposed within the internal through passage 74. As shown in FIG. 4D, for example, the pilot piston 76 may be disposed within the internal through passage 74 between the first and second ends 70*a*, 70*b* of the housing 68. According to one or more embodiments of the present disclosure, the pilot piston 76 may be affixed within the internal through passage 74 of the valve block 66 in an initial position via a locking mechanism 80. According to one or more embodiments of the present disclosure, the locking mechanism 80 may include a shear screw, as shown in FIGS. 4A-4E and FIG. 6, for example, or a split nut having a retaining ring, as shown in FIG. 9, for example. In the initial position of the pilot piston 76, the lower chamber 72*c* and the upper chamber 72*d* of the valve block 66 housing 68 are in fluid communication with each other, according to one or more embodiments of the present disclosure.

Figure 4E:
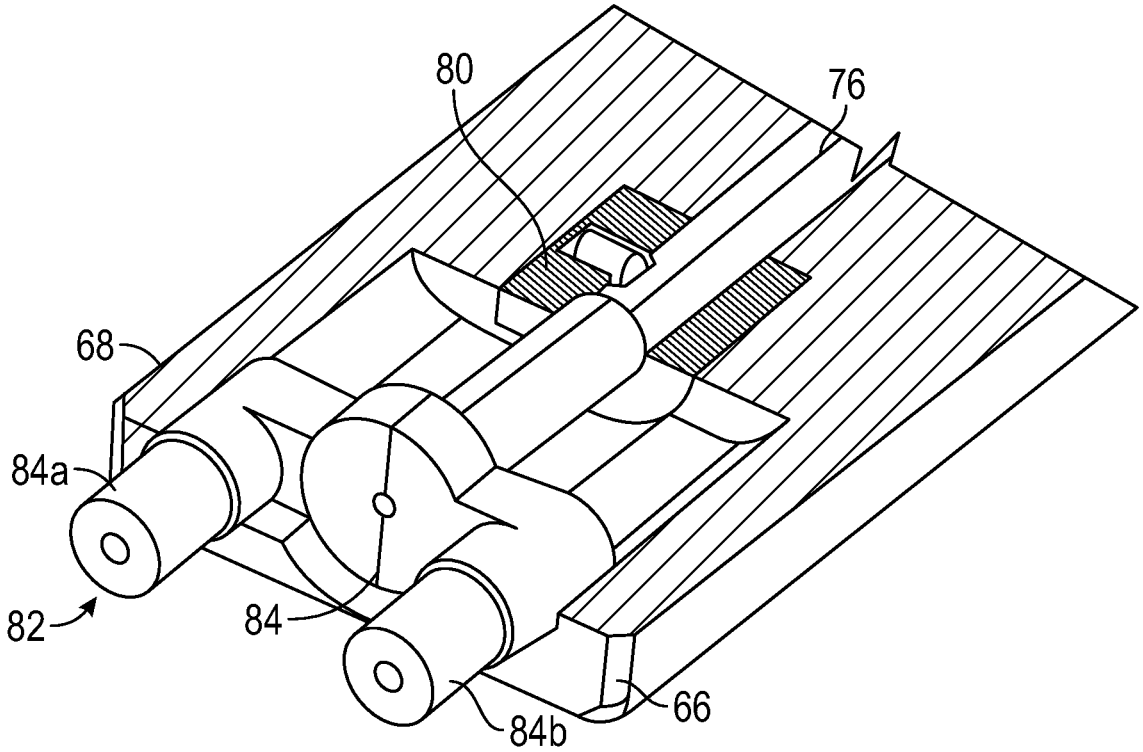
Figure 5:
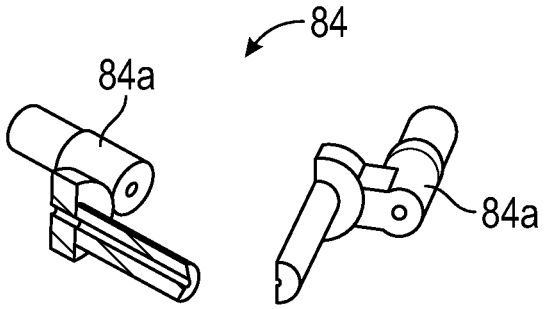
FIG. 5 shows a perspective view of an actuating piston of a redundant trigger section, according to one or more embodiments of the present disclosure.
Figure 6:
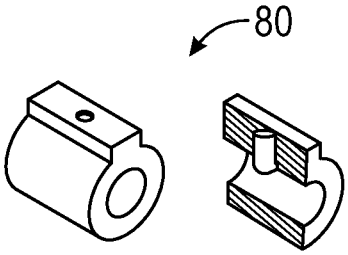
FIG. 6 shows perspective and cross-sectional views of a locking mechanism of a redundant trigger section, according to one or more embodiments of the present disclosure.
Figure 8A:
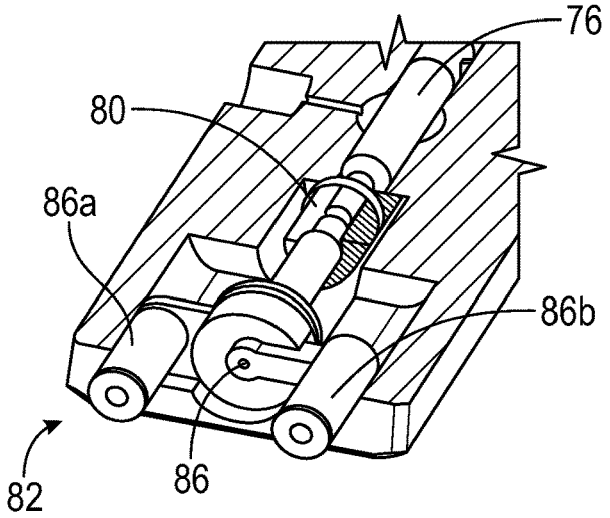
FIGS. 8A and 8B show a partial cross-sectional view of a valve block of a redundant trigger section, according to one or more embodiments of the present disclosure.
Figure 8B:
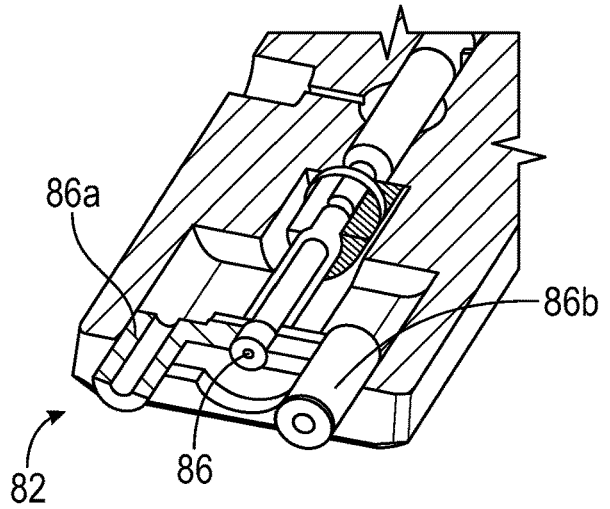

Referring specifically to FIGS. 4B and 4E, the valve block 66 of the redundant trigger section 50 according to one or more embodiments of the present disclosure may also include an actuating piston 82 connected to the pilot piston 76 at the first end 70*a* of the housing 68. According to one or more embodiments of the present disclosure, the actuating piston 82 may be a split piston 84, comprising two pistons 84*a*, 84*b*, as shown in FIG. 4E, for example. FIG. 5 shows additional perspective views of one of the pistons 84*a* of the split piston 84, for example. According to other embodiments of the present disclosure, the actuating piston 82 may be a concentric piston 86, as shown in FIGS. 8A and 8B, and as further described below, for example. In one or more embodiments of the present disclosure, the actuating piston 82 may be welded to the valve block 66, as shown in FIG. 4C, for example. According to or more embodiments of the present disclosure, the plurality of triggers 64 of the redundant trigger section 50 may be mechanically connected to the actuating piston 82. For example, according to one or more embodiments of the present disclosure, the plurality of triggers 64 may be mechanically connected to the actuating piston 82 via a plurality of couplings 88, as shown in FIG. 4D, for example.

Figure 7A:
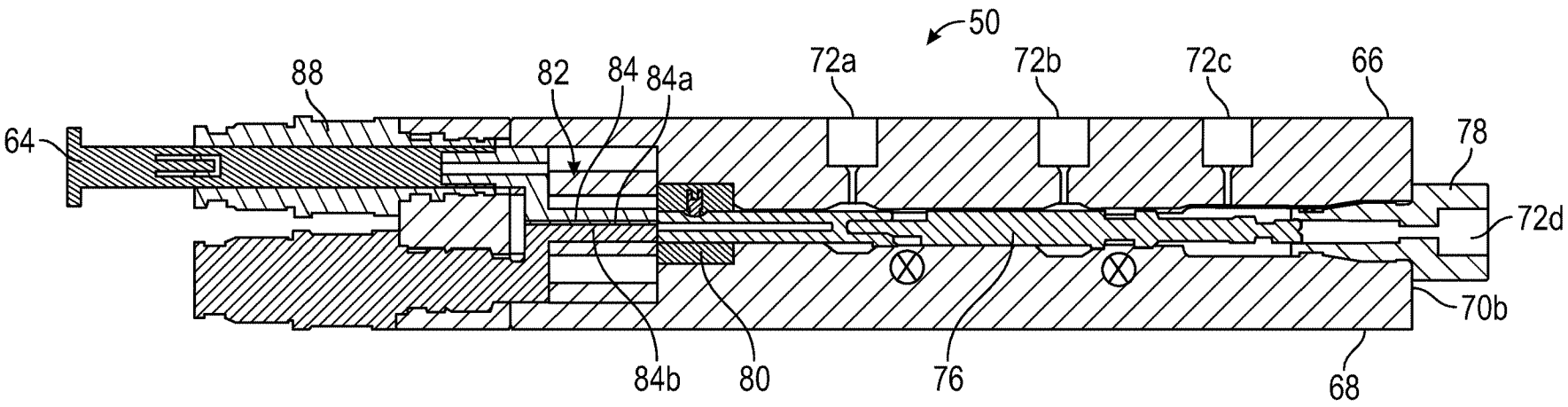
FIGS. 7A and 7B show a redundant trigger section having an actuating piston before and after activation, according to one or more embodiments of the present disclosure.
Figure 7B:
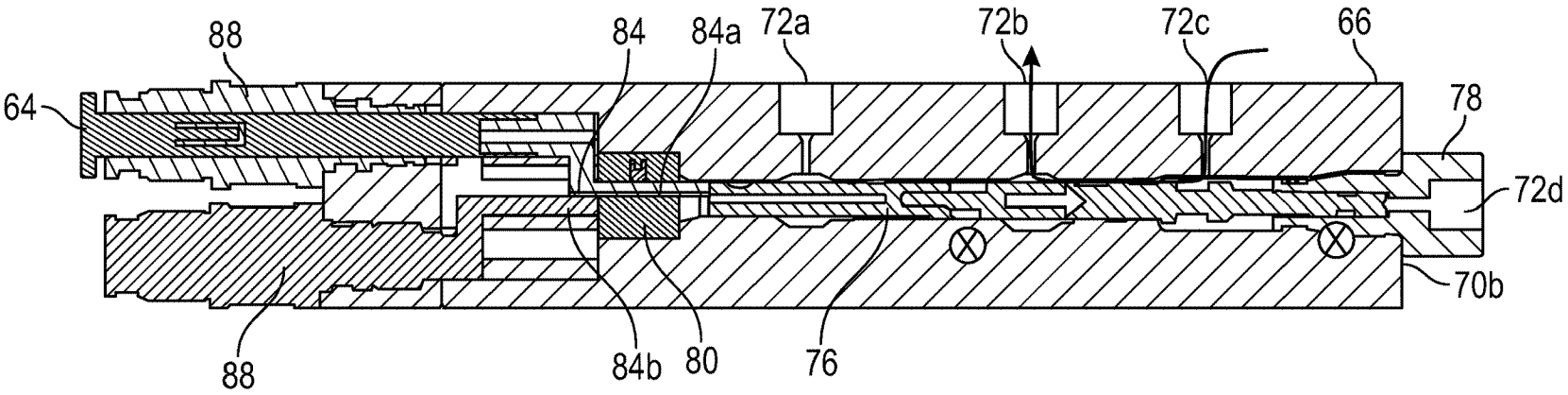

Referring now to FIGS. 7A and 7B, a redundant trigger section 50 having a split piston 84 as the actuating piston 82, according to one or more embodiments of the present disclosure, is shown before and after activation. In a method according to one or more embodiments of the present disclosure, an isolation valve 38 including the redundant trigger section 50 having the split piston 84 as the actuating piston 82, as previously described, is deployed in the wellbore 34. As shown in FIG. 7A, before activation, the pilot piston 76 is in an initial position in which the pilot piston 76 is disposed and secured within the internal through passage 74 via the locking mechanism 80, and the upper chamber 72*d* and the lower chamber 72*c* of the valve block 66 are in fluid communication with each other. After deployment, a controlled signal is applied to the redundant trigger section 50 to activate at least one trigger 64 of the plurality of triggers, as shown in FIG. 7B. In one or more embodiments of the present disclosure, the at least one activated trigger 64 may be used to actuate a corresponding piston 84*a* of the split piston 84. For redundancy, the other trigger 64 may be used to actuate the corresponding piston 84*b* of the split piston 84 in a similar way to that described below. As shown in FIG. 7B, for example, one of the pistons 84*a* of the split piston 84 corresponding to the activated trigger 64 exerts enough pressure to shear the shear screw of the locking mechanism 80 and push the pilot piston 76 within the internal through passage 74 of the housing 68 until the pilot piston 76 reaches a final position within the internal through passage 74. According to one or more embodiments of the present disclosure, when the pilot piston 76 is in the final position, the lower chamber 72*c* and the upper chamber 72*d* of the valve block 66 are isolated from each other. Also according to one or more embodiments of the present disclosure, when the pilot piston 76 is in the final position, the lower 72*c* and the atmospheric pressure chamber 72*b* are in fluid communication with each other, as shown in FIG. 7B, for example. When the pilot piston 76 is in the final position, the emptying of the lower chamber 72*c* into the atmospheric pressure chamber 72*b* creates a pressure differential that actuates the mechanical section 46, which is connected to the redundant trigger section 50 via the lower coupling 78, and thus the ball section 42, of the isolation valve 38. Since each trigger 64 of the plurality of triggers 64 is independent from the other, the triggers 64 may be easily interchanged with respect to the connection of the triggers 64 to the split piston 84. Moreover, the redundant trigger section 50 having the split piston 84 as the actuating piston 82 may also work with a single trigger 64 according to one or more embodiments of the present disclosure.

Figure 10A:
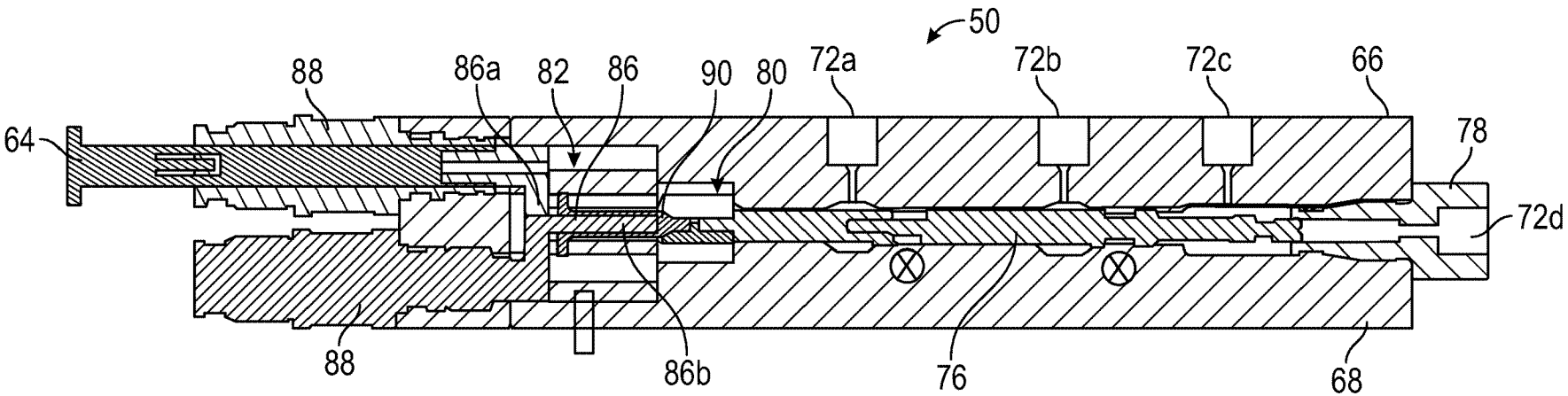
FIGS. 10A and 10B show a redundant trigger section having an actuating piston before and after activation, according to one or more embodiments of the present disclosure.
Figure 10B:
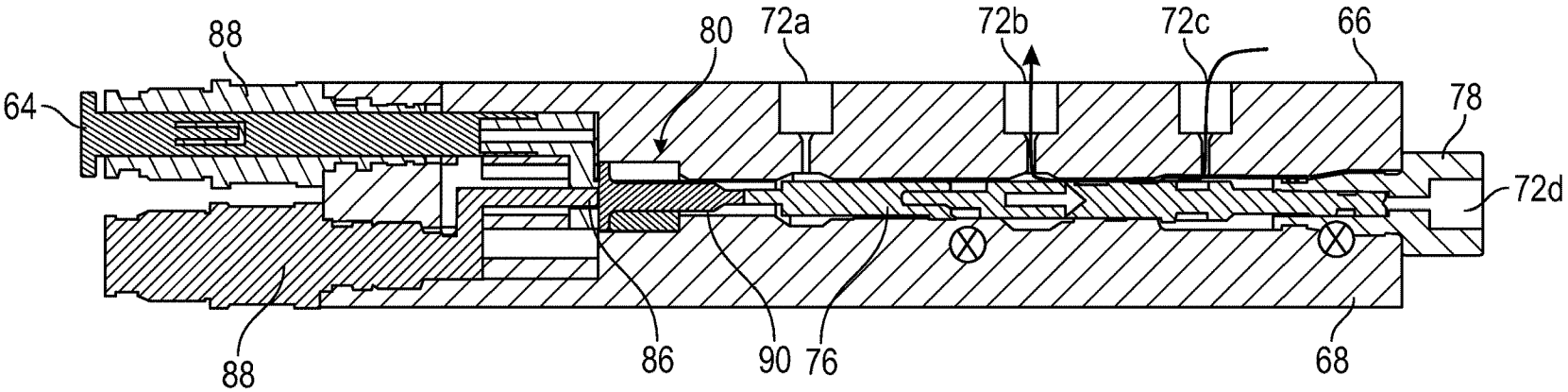

Referring now to FIGS. 10A and 10B, a redundant trigger section 50 having a concentric piston 86 as the actuating piston 82, according to one or more embodiments of the present disclosure, is shown before and after activation. In a method according to one or more embodiments of the present disclosure, an isolation valve 38 including the redundant trigger section 50 having the concentric piston 86 as the actuating piston 82, as previously described, is deployed in the wellbore 34. As shown in FIG. 10A, before activation, the pilot piston 76 is in an initial position in which the pilot piston 76 is disposed and secured within the internal through passage 74 via the locking mechanism 80, which may be a split nut having a retaining ring, and the upper chamber 72*d* and the lower chamber 72*c* of the valve block 66 are in fluid communication with each other. After deployment, a controlled signal is applied to the redundant trigger section 50 to activate at least one trigger 64 of the plurality of triggers, as shown in FIG. 10B. In one or more embodiments of the present disclosure, the at least one activated trigger 64 may be used to actuate a corresponding piston 86*a* of the concentric piston 86. For redundancy, the other trigger 64 may be used to actuate the corresponding piston 86*b* of the concentric piston 86 in a similar way to that described below. As shown in FIG. 10B, for example, one of the pistons 86*a* of the concentric piston 86 corresponding to the activated trigger 64 exerts enough pressure to push an intermediary piece 90 through the split nut of the locking mechanism 80, expanding the retaining ring, and pushing the pilot piston 76 within the internal through passage 74 of the housing 68 until the pilot piston 76 reaches a final position within the internal through passage 74. According to one or more embodiments of the present disclosure, when the pilot piston 76 is in the final position, the lower chamber 72*c* and the upper chamber 72*d* of the valve block 66 are isolated from each other. Also according to one or more embodiments of the present disclosure, when the pilot piston 76 is in the final position, lower chamber 72*c* and the atmospheric pressure chamber 72*b* are in fluid communication with each other, as shown in FIG. 10B, for example. When the pilot piston 76 is in the final position, the emptying of the lower chamber 72*c* into the atmospheric pressure chamber 72*b* creates a pressure differential that actuates the mechanical section 46, which is connected to the redundant trigger section 50 via the lower coupling 78, and thus the ball section 42, of the isolation valve 38. Since each trigger 64 of the plurality of triggers 64 is independent from the other, the triggers 64 may be easily interchanged with respect to the connection of the triggers 64 to the concentric piston 86. Moreover, the redundant trigger section 50 having the concentric piston 86 as the actuating piston 82 may also work with a single trigger 64 according to one or more embodiments of the present disclosure.

Figure 11:
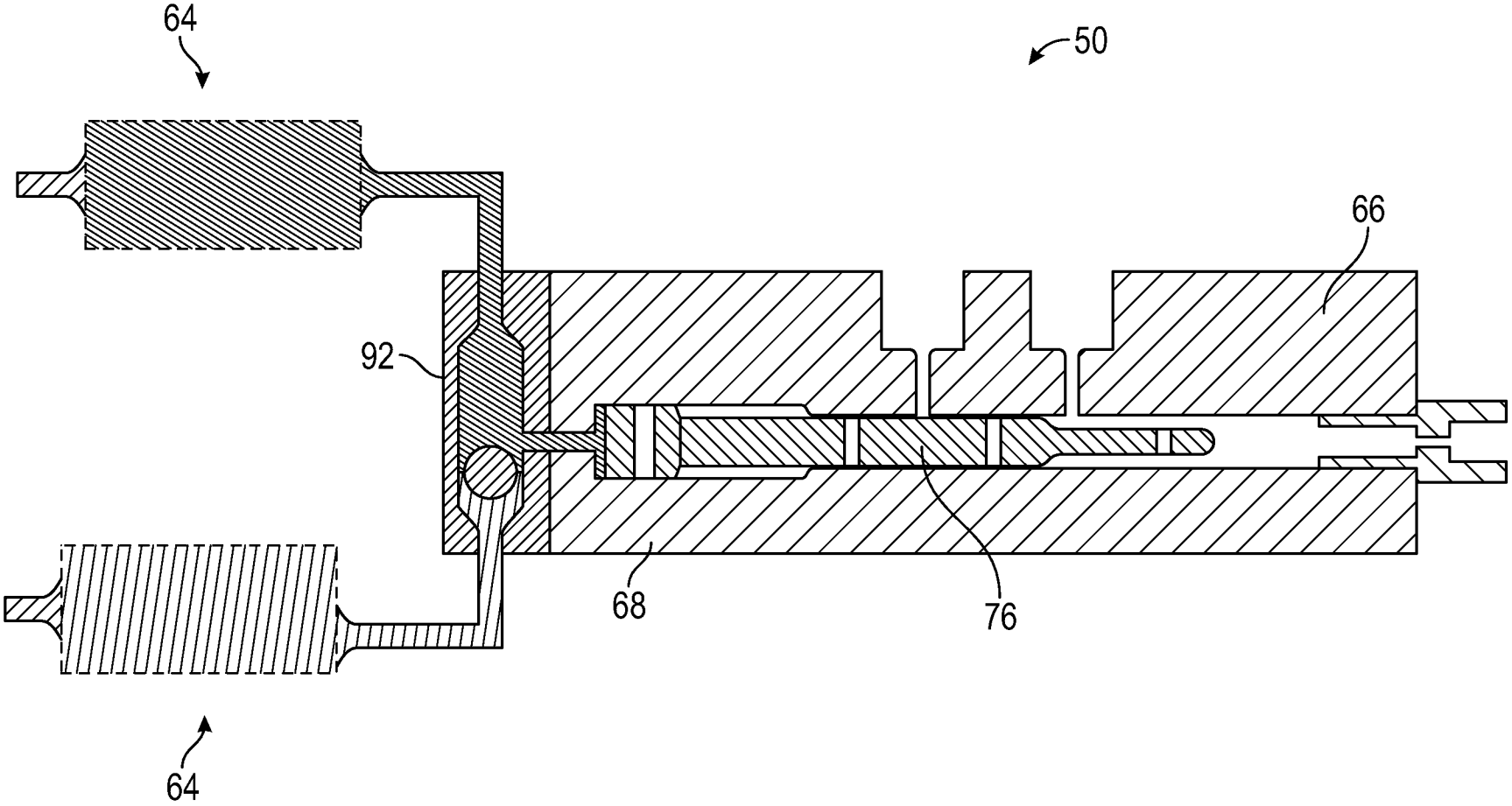
FIG. 11 shows a redundant trigger section having a shuttle valve before the valve block, according to one or more embodiments of the present disclosure.

Referring now to FIG. 11, a redundant trigger section 50 having a shuttle valve 92 before the valve block 66, according to one or more embodiments of the present disclosure, is shown. As shown in FIG. 11, the shuttle valve 92 is disposed at an uphole end of the housing 68 of the valve block 66, and the shuttle valve 92 is hydraulically connected to the pilot piston 76, according to one or more embodiments of the present disclosure. As also shown in FIG. 11, a plurality of triggers 64 is hydraulically connected to the shuttle valve 92, the plurality of triggers 64 being exposed to tubing pressure. According to one or more embodiments of the present disclosure, the plurality of triggers 64 acts as a plurality of valves controlling an input of hydraulic fluid into the valve block 66, as further described below.

Figure 12A:
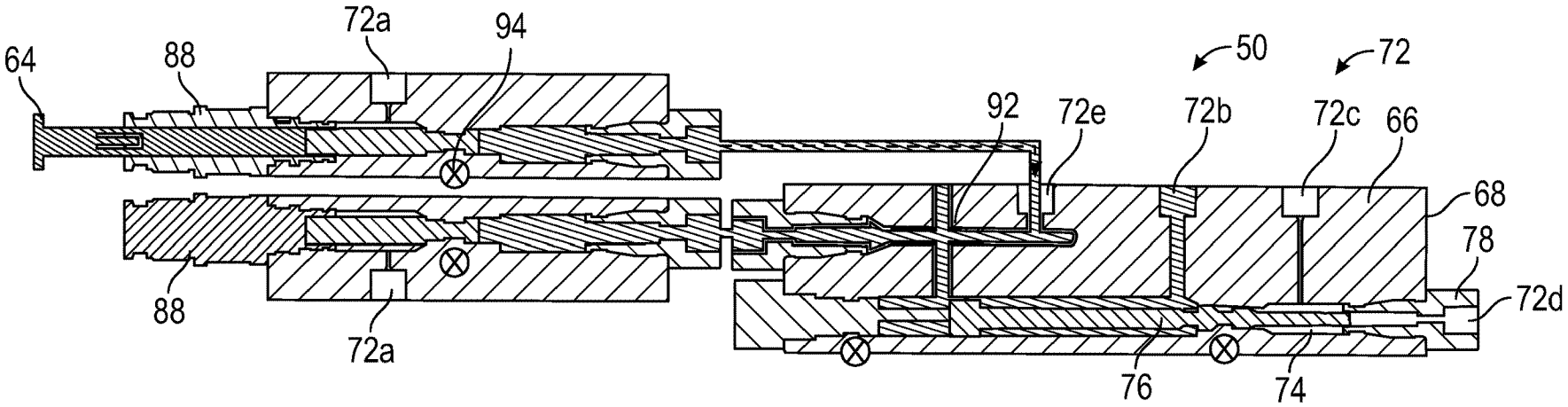
FIGS. 12A and 12B show a redundant trigger section having a shuttle valve before the valve block before and after activation, according to one or more embodiments of the present disclosure.
Figure 12B:
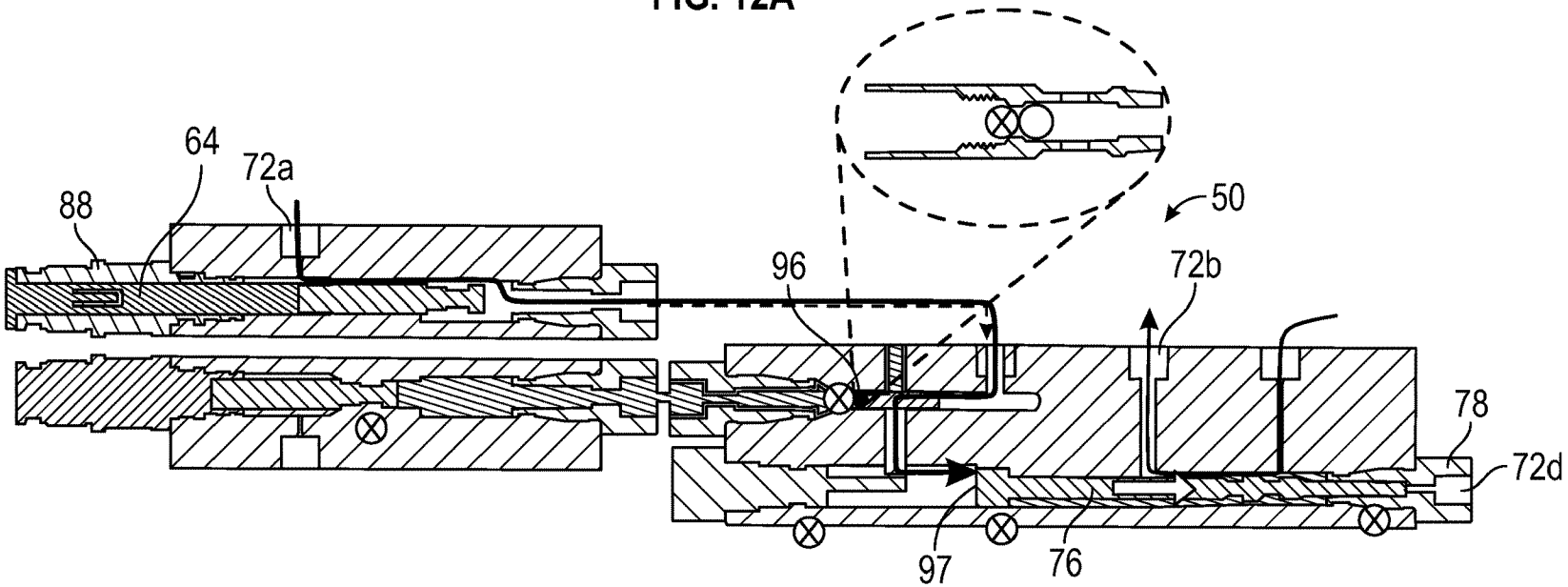

Referring now to FIGS. 12A and 12B, a redundant trigger section 50 having a shuttle valve 92 before the valve block 66, according to one or more embodiments of the present disclosure, is shown before and after activation. As shown in FIG. 12A, the valve block 66 of the redundant trigger section 50 includes a housing 68 having an internal through passage 74. As further shown in FIG. 12A, the valve block 66 of the redundant trigger section 50 according to one or more embodiments of the present disclosure includes a plurality of chambers 72 formed in a wall of the housing 68. As shown in FIG. 12A, the plurality of chambers 72 formed in the wall of the housing 68 may include a shuttle valve pressure chamber 72*e* connected to the shuttle valve 92, an atmospheric pressure chamber 72*b*, a lower chamber 72*c*, and an upper chamber 72*d*. According to one or more embodiments of the present disclosure, the upper chamber 72*d* is disposed at a downhole end of the housing 68 of the valve block 66, and the upper chamber 72*d* may be coaxial with the internal through passage 74 of the housing 68. Further, as shown in FIG. 12A, a lower coupling 78 may be disposed at the upper chamber 72*d*, the lower coupling 78 being configured to couple the valve block 66 of the redundant trigger section 50 to the mechanical section 46 of the isolation valve 38, as previously described.

Still referring to FIG. 12A, a pilot piston 76 may be disposed within the internal through passage 74 of the housing 68 of the valve block 66. As further shown in FIG. 12A, trigger 64 is hydraulically connected to the shuttle valve 92, and the trigger 64 is exposed to tubing pressure, via first tubing pressure chamber 72*a*, for example. Although FIG. 12A shows only one trigger 64 hydraulically connected to the shuttle valve 92 via one of the couplings 88, it is understood that an additional trigger 64 may be hydraulically connected to the shuttle valve 92 via the other coupling 88, and may be exposed to tubing pressure, according to one or more embodiments of the present disclosure. According to one or more embodiments of the present disclosure, the trigger 64 acts as a valve controlling an input of hydraulic fluid into the valve block 66 via the shuttle valve pressure chamber 72*e* and the shuttle valve 92 to move the pilot piston 76 from an initial position to a final position, as further described below.

Referring now to FIGS. 12A and 12B, in a method according to one or more embodiments of the present disclosure, an isolation valve 38 including the redundant trigger section 50 having a shuttle valve 92 disposed uphole of the valve block 66, and being hydraulically connected to the pilot piston 76, as previously described, is deployed in the wellbore 34. As shown in FIG. 12A, before activation, the pilot piston 76 is in an initial position in which the pilot piston 76 is disposed within the internal through passage 74, and the upper chamber 72*d* and the lower chamber 72*c* of the valve block 66 are in fluid communication with each other. After deployment, a controlled signal is applied to the redundant trigger section 50 to activate at least one trigger 64 of the plurality of triggers, as shown in FIG. 12B. In one or more embodiments of the present disclosure, the at least one activated trigger 64 may be used to act as a valve to control the input of hydraulic fluid into the valve block 66 from the shuttle valve 92. For redundancy, the other trigger 64 may be used to act as a valve to control the input of hydraulic fluid into the valve block 66 from the shuttle valve 92 in a similar way to that described below. In one or more embodiments of the present disclosure, each of the plurality of triggers 64 may be hydraulically triggered, each of the plurality of triggers 64 may be electronically triggered, or the plurality of triggers 64 may be either hydraulically or electronically triggered in combination, without departing from the scope of the present disclosure. As shown in FIGS. 12A and 12B, for example, the activated trigger 64 acting as a hydraulic valve opens and otherwise removes a barrier 94 downstream of the first tubing pressure chamber 72*a*. As a result, hydraulic fluid is able to flow through the first tubing pressure chamber 72*a*, through the opened barrier 94, into the shuttle valve pressure chamber 72*e*, through the shuttle valve 92, which may include a check valve 96 to prevent backflow of hydraulic fluid toward the other trigger 64, and onto a fluid receiving surface 97 of the pilot piston 76. According to one or more embodiments of the present disclosure, the force of hydraulic fluid on the fluid receiving surface 97 of the pilot piston 76 is able to move the pilot piston 76 within the internal through passage 74 of the housing 68 until the pilot piston 76 reaches a final position within the internal through passage 74. According to one or more embodiments of the present disclosure, when the pilot piston 76 is in the final position, the lower chamber 72*c* and the upper chamber 72*d* of the valve block 66 are isolated from each other. Also according to one or more embodiments of the present disclosure, when the pilot piston 76 is in the final position, the low pressure chamber 72 and the atmospheric pressure chamber 72*b* are in fluid communication with each other, as shown in FIG. 12B, for example. When the pilot piston 76 is in the final position, the emptying of the lower chamber 72*c* into the atmospheric pressure chamber 72*b* creates a pressure differential that actuates the mechanical section 46, which is connected to the redundant trigger section 50 via the lower coupling 78, and thus the ball section 42, of the isolation valve 38. In the redundant trigger section 50 having the shuttle valve 92 according to one or more embodiments of the present disclosure, each trigger 64 of the plurality of triggers 64 may be independent from the other. Further, according to one or more embodiments of the present disclosure, the redundant trigger section 50 may work with a single trigger 64 by bypassing the shuttle valve 92, for example. Additionally, a shuttle valve 92, or equivalent, with more than two inputs may allow for the installation of more than two triggers 64 in the redundant trigger section 50 according to one or more embodiments of the present disclosure.

Figure 13:
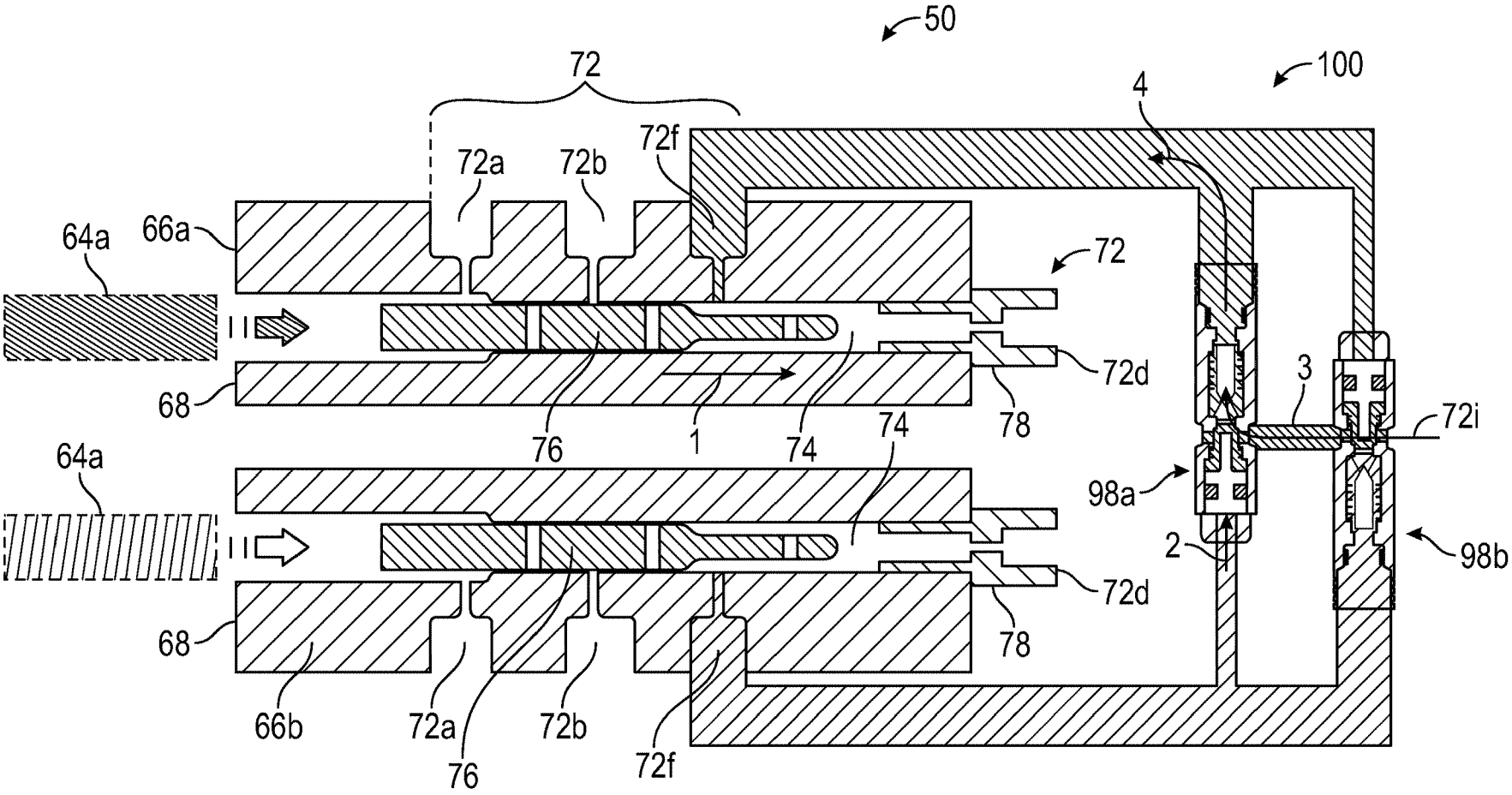
FIG. 13 shows a redundant trigger section having two triggers and valve blocks integrated with pilot check valve assemblies, according to one or more embodiments of the present disclosure.

Referring now to FIG. 13, a redundant trigger section 50 having two triggers 64 and valve blocks 66 integrated with pilot check valve assemblies 98*a*, 98*b*, according to one or more embodiments of the present disclosure, is shown. As shown in FIG. 13, a first trigger 64*a* is connected to a first valve block 66*a*, and a second trigger 64*b* is connected to a second valve block 66*b*. According to one or more embodiments of the present disclosure, one or both of the first and second triggers 64*b* may be hydraulic or electronic triggers, as previously described. Further, the first trigger 64*a* connected to the first valve block 66*a* is independent from the second trigger 64*b* connected to the second valve block 66*b*, according to one or more embodiments of the present disclosure. As further shown in FIG. 13, each of the first and second valve blocks 66*a*, 66*b* includes a housing 68 having an internal through passage 74, and a pilot piston 76 disposed within the internal through passage 74 of the housing 68. As further shown in FIG. 13, the valve blocks 66*a*, 66*b* of the redundant trigger section 50 according to one or more embodiments of the present disclosure include a plurality of chambers 72 formed in the wall of the housing 68. As shown in FIG. 13, the plurality of chambers 72 formed in the wall of the housing 68 may include a first tubing pressure chamber 72*a*, an atmospheric pressure chamber 72*b*, a second tubing pressure chamber 72*f* hydraulically connected to a manifold 100 of the redundant trigger section 50, and an upper chamber 72*d*. According to one or more embodiments of the present disclosure, the upper chamber 72*d* is disposed at a downhole end of the housing 68 of the corresponding valve block 66, and the upper chamber 72*d* may be coaxial with the internal through passage 74 of the housing 68. Further, as shown in FIG. 13, a lower coupling 78 may be disposed at the upper chamber 72*d*, the lower coupling 78 being configured to couple the valve block 66*a*, 66*b* of the redundant trigger section 50 to the mechanical section 46 of the isolation valve 38, as previously described.

Still referring to FIG. 13, the redundant trigger section 50 according to one or more embodiments of the present disclosure may include a manifold 100 hydraulically connected to the second tubing pressure chambers 72*f* of the first and second valve blocks 66*a*, 66*b*. As shown in FIG. 13, the manifold 100 may include, inter alia, a central chamber 72*i* and first and second pilot check valve assemblies 98*a*, 98*b*, according to one or more embodiments of the present disclosure.

Figure 14A:
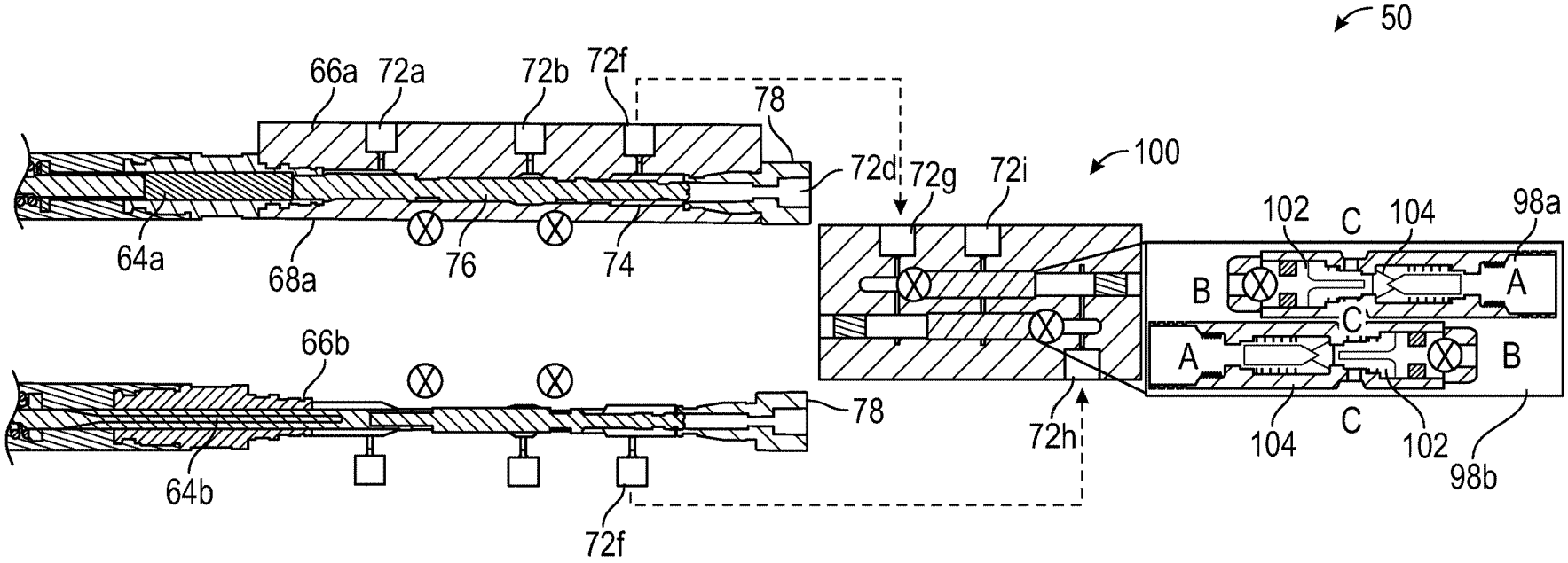
FIGS. 14A and 14B show a redundant trigger section having two triggers and valve blocks integrated with pilot check valve assemblies before and after activation, according to one or more embodiments of the present disclosure.
Figure 14B:
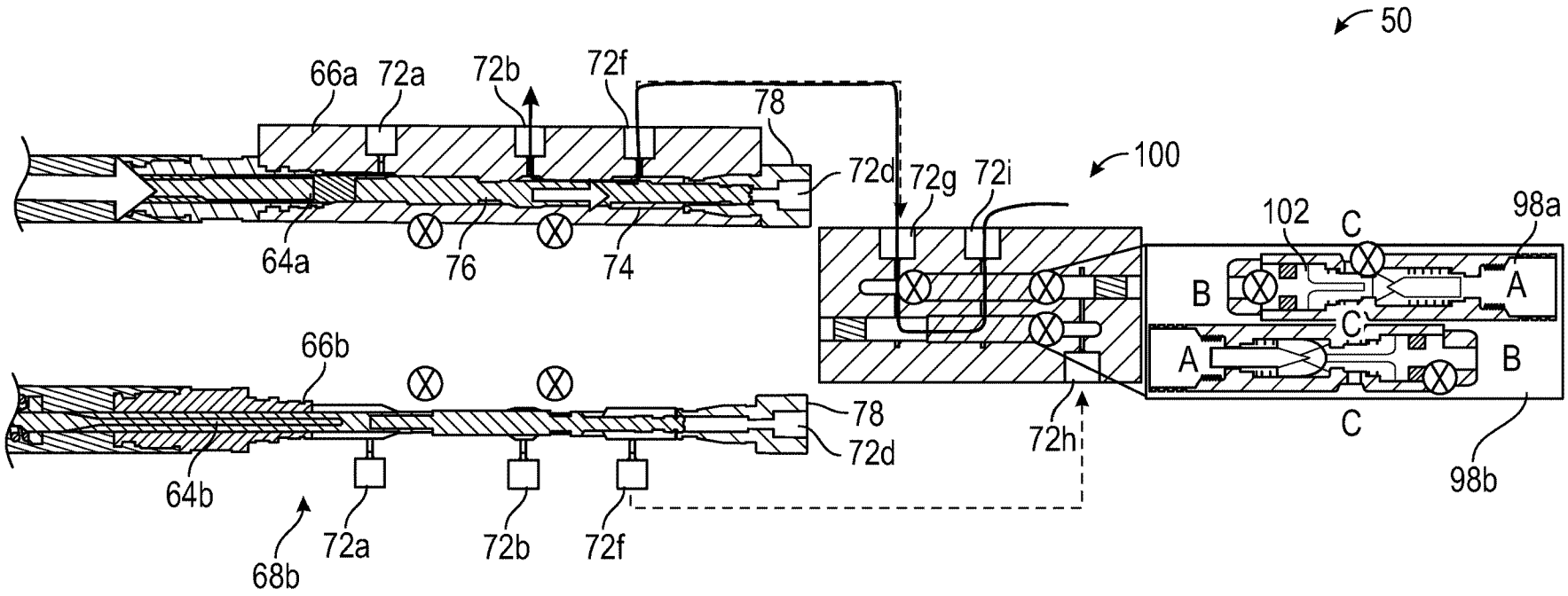

Referring now to FIGS. 14A and 14B, the redundant trigger section 50 having two triggers 64*a*, 64*b* and valve blocks 66*a*, 66*b* integrated with pilot check valve assemblies 98*a*, 98*b*, according to one or more embodiments of the present disclosure, is shown before and after activation. As shown in FIG. 14A, in addition to the central chamber 72*i* and the first and second pilot check valve assemblies 98*a*, 98*b*, the manifold 100 further includes a third tubing pressure chamber 72*g* that is hydraulically connected to the second tubing pressure chamber 72*f* of the first valve block 66*a*, and a fourth tubing pressure chamber 72*h* that is hydraulically connected to the second tubing pressure chamber 72*f* of the second valve block 66*b*, according to one or more embodiments of the present disclosure.

Still referring to FIG. 14A, according to one or more embodiments of the present disclosure, the first and second pilot check valve assemblies 98*a*, 98*b* of the manifold 100 include a plurality of ports A, B, and C, a pilot check piston 102, and a pilot check valve 104. According to one or more embodiments of the present disclosure, port A is proximate the pilot check valve 104, port B is proximate the pilot check piston 102, and port C is disposed between port A and port B. According one or more embodiments of the present disclosure, port B of the first and second pilot check valve assemblies 98*a*, 98*b* remains sealed. Further, port C of the first and second pilot check valve assemblies 98*a*, 98*b* is included in a central connection between the first and second pilot check valve assemblies 98*a*, 98*b*, in one or more embodiments of the present disclosure. Further, port C of the first and second pilot check valve assemblies 98*a*, 98*b* is connected to the central chamber 72*i* of the manifold 100, according to one or more embodiments of the present disclosure. Moreover, port C of the first and second pilot check valve assemblies 98*a*, 98*b* is hydraulically connected to the first and second valve blocks 66*a*, 66*b*, according to one or more embodiments of the present disclosure.

Referring now to FIGS. 14A and 14B, in a method according to one or more embodiments of the present disclosure, an isolation valve 38 including the redundant trigger section 50 having the manifold 100 hydraulically connected to the second tubing pressure chambers 72*f* of the first and second valve blocks 66*a*, 66*b*, as previously described, is deployed in the wellbore 34. As shown in FIG. 14A, before activation, the pilot piston 76 is in an initial position in which the pilot piston 76 is disposed within the internal through passage 74, and second tubing pressure chamber 72*f* and the upper chamber 72*d* are in fluid communication with each other. After deployment, a controlled signal is applied to the first tubing pressure chamber 72*a* of the first valve block 66*a* to activate the first trigger 64*a*, as shown in FIG. 14A. In one or more embodiments of the present disclosure, the activated first trigger 64*a* pushes the pilot piston 76 of the first valve block 66*a* within the internal through passage 74 of the housing 68*a* of the first valve block 66*a* from the initial position to a final position. According to one or more embodiments of the present disclosure, in the final position, the second tubing pressure chamber 72*f* of the first valve block 66*a* is isolated from the upper chamber 72*d* of the first valve block 66*a*. According to one or more embodiments of the present disclosure, the second tubing pressure chamber 72*f* of the second valve block 66*b* inputs tubing pressure into the fourth tubing pressure chamber 72*h* of the manifold 100, which seals the pilot check valve 104 of the first pilot check valve assembly 98*a*, and presses the pilot check piston 102 of the second pilot check valve assembly 98*b* into the pilot check valve 104 of the second pilot check valve assembly 98*b*, thereby opening free flow from port C to port A of the second pilot check valve assembly 98*b*. According to one or more embodiments of the present disclosure, fluid that flows into the central chamber 72*i* of the manifold 100 is directed through port C of the first and second pilot check valve assemblies 98*a*, 98*b*, through port A of the second pilot check valve assembly 98*b*, into the third tubing pressure chamber 72*g* of the manifold 100, into the second tubing pressure chamber 72*f* of the first valve block 66*a*, and into the atmospheric pressure chamber 72*b* of the first valve block 66*a*. According to one or more embodiments of the present disclosure, draining the fluid from the central chamber 72*i* of the manifold 100 into the atmospheric pressure chamber 72*b* of the first valve block 66*a* creates a pressure differential that actuates the mechanical section 46, which is connected to the redundant trigger section 50 via the lower coupling 78 of the first valve block 66*a*, and thus the ball section 42, of the isolation valve 38.

In the previously described method in view of FIGS. 14A and 14B, after deployment of the isolation valve 38 including the redundant trigger section 50 having the hydraulically connected manifold 100 in the wellbore, a controlled signal was applied to the first tubing pressure chamber 72*a* of the first valve block 66*a* to activate the first trigger 64*a*. In other embodiments of the present disclosure, a controlled signal may be applied to the first tubing pressure chamber 72*a* of the second valve block 66*b* to activate the second trigger 64*b*. In one or more embodiments of the present disclosure, the activated second trigger 64*b* pushes the pilot piston 76 of the second valve block 66*a* within the internal through passage 74 of the housing 68*b* of the second valve block 66*b* from the initial position to the final position. According to one or more embodiments of the present disclosure, in the initial position, the second tubing pressure chamber 72*f* of the second valve block 66*b* is in fluid communication with the upper chamber 72*d* of the second valve block 66*b*. According to one or more embodiments of the present disclosure, in the final position, the second tubing pressure chamber 72*f* of the second valve block 66*b* is isolated from the upper chamber 72*d* of the second valve block 66*b*. According to one or more embodiments of the present disclosure, the second tubing pressure chamber 72*f* of the first valve block 66*a* inputs tubing pressure into the third tubing pressure chamber 72*g* of the manifold 100, which seals the pilot check valve 104 of the second pilot check valve assembly 98*b*, and presses the pilot check piston 102 of the first pilot check valve assembly 98*a* into the pilot check valve 104 of the first pilot check valve assembly 98*a*, thereby opening free flow from port C to port A of the first pilot check valve assembly 98*a*. According to one or more embodiments of the present disclosure, fluid that flows into the central chamber 72*i* of manifold is directed through port C to port A of the first pilot check valve assembly 98*a*, into the fourth tubing pressure chamber 72*h* of the manifold 100, into the second tubing pressure chamber 72*f* of the second valve block 66*b*, and into the atmospheric pressure chamber 72*b* of the second valve block 66*b*. According to one or more embodiments of the present disclosure, draining the fluid from the central chamber 72*i* of the manifold into the atmospheric pressure chamber 72*b* of the second valve block 66*b* creates a pressure differential that actuates the mechanical section 46, which is connected to the redundant trigger section 50 via the lower coupling 78 of the second valve block 66*b*, and thus the ball section 42, of the isolation valve 38.

Figure 15:
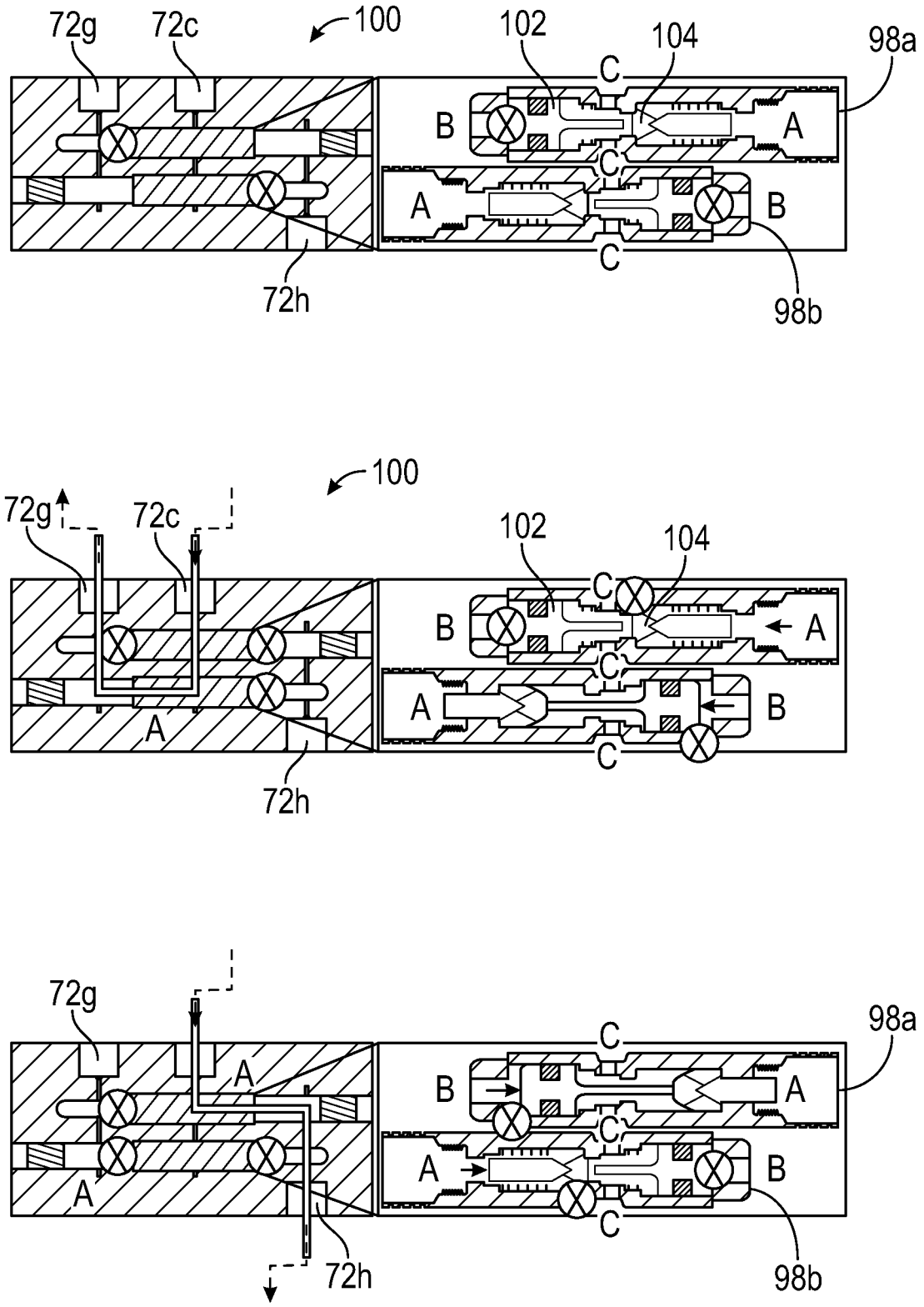
FIG. 15 shows a comparison between an initial state and two final states of a manifold of a redundant trigger section having first and second piston valve assemblies, according to one or more embodiments of the present disclosure.

Referring now to FIG. 15, a comparison between an initial state and two final states of a manifold 100 of a redundant trigger section 50 having first and second piston valve assemblies 98*a*, 98*b*, according to one or more embodiments of the present disclosure is shown. Specifically, FIG. 15 shows Final State A of the manifold 100 of a method according to one or more embodiments of the present disclosure in which the controlled signal was applied to the first tubing pressure chamber 72*a* of the first valve block 66*a* to actuate the first trigger 64*a*, as previously described, and the resulting flow path of fluid through the manifold. Further, FIG. 15 shows Final State B of the manifold 100 of another method according to one or more embodiments of the present disclosure in which the controlled signal was applied to the first tubing pressure chamber 72*a* of the second valve block 66*b* to activate the second trigger 64*b*, as previously described, and the resulting flow path of fluid through the manifold 100. Notably, by bypassing the pilot check valve assemblies 98*a*, 98*b*, the redundant trigger section 50 according to one or more embodiments of the present disclosure may work with a single trigger 64 as well.

According to one or more embodiments of the present disclosure, the first and second triggers 64*a*, 64*b* may be activated simultaneously, once the pilot pistons 76 corresponding to the first and second triggers 64*a*, 64*b* move into the final position. Such a configuration may facilitate communication between port C and port A of the first and second pilot check valve assemblies 98*a*, 98*b*.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string having an isolation valve disposed along the well string to selectively block or allow fluid flow along an interior of the well string, the isolation valve comprising:

a ball section having a ball valve element rotatable between a closed position and an open position;

a mechanical section coupled with the ball section to rotate the ball valve element; and a redundant trigger section that actuates the mechanical section, and thus the ball section, in response to a controlled signal, the redundant trigger section having:

a valve block having a housing comprising a first end and a second end, the valve block further comprising:

a pilot piston disposed within an internal through passage of the housing between the first and second ends of the housing, the pilot piston having an initial position;

a plurality of chambers formed in a wall of the housing, the plurality of chambers including:

a first tubing pressure chamber; an atmospheric pressure chamber;

a lower chamber; and an upper chamber, wherein the upper chamber is disposed at the second end of the housing, the upper chamber being coaxial with the internal through passage of the housing; and an actuating piston connected to the pilot piston at the first end of the housing;

a plurality of triggers connected to the actuating piston;

wherein, upon receipt of the controlled signal by the first tubing pressure chamber, at least one trigger of the plurality of triggers activates the actuating piston, which pushes the pilot piston within the internal through passage of the housing from the initial position to a final position; and a lower coupling disposed at the upper chamber that couples the valve block to the mechanical section.

2. The system of claim 1, wherein each trigger of the plurality of triggers is independent.

3. The system of claim 1, wherein the pilot piston is affixed within the internal through passage in the initial position via a locking mechanism.

4. The system of claim 1, wherein the lower chamber and the upper chamber are in fluid communication with each other when the pilot piston is in the initial position; and wherein, when the pilot piston is in the final position:

the lower chamber and the atmospheric pressure chamber are in fluid communication with each other; and the lower chamber and the upper chamber are isolated from each other.

5. A system, comprising:

a redundant trigger section that actuates a device between operational positions in response to a controlled signal, the redundant trigger section comprising:

a housing comprising: an internal through passage; and a plurality of chambers formed in a wall of the housing;

a pilot piston disposed within the internal through passage of the housing, the pilot piston having an initial position;

an actuating piston connected to the pilot piston at a first end of the housing, wherein the plurality of chambers comprises: a first tubing pressure chamber; an atmospheric pressure chamber; a lower chamber; and an upper chamber, wherein the upper chamber is disposed at a second end of the housing opposite the first end of the housing, the upper chamber being coaxial with the internal through passage of the housing; and a plurality of triggers connected to the actuating piston, wherein, upon receipt of the controlled signal by the first tubing pressure chamber, at least one trigger of the plurality of triggers activates the actuating piston, which pushes the pilot piston within the internal through passage of the housing from the initial position to a final position.

6. The system of claim 5, wherein the redundant trigger section is configured to actuate a mechanical section of an isolation valve.

7. The system of claim 6, the redundant trigger section further comprising a lower coupling disposed at the upper chamber that couples the housing to the mechanical section.

8. The system of claim 5, wherein the at least one trigger of the plurality of triggers is a hydraulic trigger.

9. The system of claim 5, wherein the at least one trigger of the plurality of triggers is an electronic trigger.

10. The system of claim 5, wherein the plurality of triggers is connected to the actuating piston via a plurality of couplings.

11. The system of claim 5, wherein the actuating piston is a split piston.

12. The system of claim 5, wherein the actuating piston is a concentric piston.

13. The system of claim 5, wherein each trigger of the plurality of triggers is independent.

14. The system of claim 5, wherein the pilot piston is affixed within the internal through passage in the initial position via a locking mechanism; and wherein the lower chamber and the upper chamber are in fluid communication with each other when the pilot piston is in the initial position.

15. A method, comprising:

deploying an isolation valve in a wellbore, the isolation valve comprising:

a ball section having a ball valve element rotatable between a closed position and an open position;

a mechanical section coupled with the ball section to rotate the ball valve element; and the redundant trigger section of claim 5;

applying a controlled signal to the redundant trigger section to activate at least one trigger of the plurality of triggers;

using the at least one activated trigger of the plurality of triggers to actuate the actuating piston;

using the actuating piston to push the pilot piston within the internal through passage of the housing; and actuating the mechanical section, and thus the ball section, of the isolation valve.

16. The method of claim 15, wherein the at least one trigger of the plurality of triggers is a hydraulic trigger.

17. The method of claim 15, wherein the at least one trigger of the plurality of triggers is an electronic trigger.

18. The method of claim 15, wherein the actuating piston is a split piston.

19. The method of claim 15, wherein the actuating piston is a concentric piston.

20. The method of claim 15, wherein the pilot piston is affixed within the internal through passage in the initial position via a locking mechanism.

* * * * *